US007562680B2

(12) United States Patent
Khoo et al.

(10) Patent No.: US 7,562,680 B2
(45) Date of Patent: Jul. 21, 2009

(54) MULTIPLE FLUID DISPENSER

(75) Inventors: Christopher Khoo, Lake in the Hills, IL (US); William A. Miller, Buffalo Grove, IL (US); James R. Cleveland, Wheaton, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 552 days.

(21) Appl. No.: 11/348,675

(22) Filed: Feb. 7, 2006

(65) Prior Publication Data

US 2007/0012376 A1 Jan. 18, 2007

Related U.S. Application Data

(63) Continuation-in-part of application No. 11/183,192, filed on Jul. 15, 2005.

(51) Int. Cl.
*B65B 1/04* (2006.01)

(52) U.S. Cl. ..... 141/86; 141/192; 141/271; 141/281; 222/599; 222/536

(58) Field of Classification Search ..... 141/2, 141/85–92, 192, 198, 250, 254, 267, 269, 141/271, 281, 337; 222/148, 597–599, 476, 222/528, 529, 536, 544, 212; 239/106, 110, 239/112

See application file for complete search history.

(56) References Cited

U.S. PATENT DOCUMENTS

| | | | | |
|---|---|---|---|---|
| 2,834,516 A | | 5/1958 | Mosher | |
| 2,838,077 A | * | 6/1958 | Cooper | 141/82 |
| 4,871,262 A | | 10/1989 | Krauss et al. | |
| 4,967,812 A | * | 11/1990 | Herzog | 141/88 |
| 5,078,302 A | | 1/1992 | Hellenberg | |
| 5,095,958 A | * | 3/1992 | Tincati | 141/91 |

(Continued)

FOREIGN PATENT DOCUMENTS

AU 81535 82 A 9/1982

(Continued)

OTHER PUBLICATIONS

International Searching Authority, "International Search Report and Written Opinion", Feb. 8, 2008, 16 Pages.

(Continued)

*Primary Examiner*—Timothy L Maust
(74) *Attorney, Agent, or Firm*—Miller, Matthias & Hull

(57) ABSTRACT

An improved multi fluid dispenser for simultaneous dispensing of a plurality of fluids shown and described. The dispenser includes a controller that is linked to a coordinator board. The controller has a memory with a plurality of recipes stored in the memory. A coordinator board is linked to a first module. The first module may include one or two pumps, each connected to a fluid reservoir. The module is then linked in series to a plurality of other modules as well as a manifold module. Each module includes a module board for controlling the pump or pumps of that module. The controller, coordinator board and module boards are all programmed for the simultaneous or sequential pumping of multiple fluids from the reservoirs through outlet nozzles of the manifold in accordance with a recipe selected by the user and retrieved from the memory of the controller.

20 Claims, 20 Drawing Sheets

U.S. PATENT DOCUMENTS

| | | | | |
|---|---|---|---|---|
| 5,116,134 | A | 5/1992 | Edwards et al. | |
| 5,119,973 | A | 6/1992 | Miller et al. | |
| 5,328,057 | A | 7/1994 | Hellenberg et al. | |
| 5,588,471 | A * | 12/1996 | Lowe | 141/83 |
| 5,622,692 | A | 4/1997 | Rigg et al. | |
| 5,690,252 | A | 11/1997 | Oleksiewicz et al. | |
| 5,697,527 | A | 12/1997 | Altieri, Jr. et al. | |
| 5,711,458 | A | 1/1998 | Langeveld et al. | |
| 5,785,960 | A | 7/1998 | Rigg et al. | |
| 5,842,641 | A * | 12/1998 | Mazzalveri | 239/104 |
| 6,273,298 | B1 | 8/2001 | Post | |
| 6,398,513 | B1 | 6/2002 | Amsler et al. | |
| 6,510,366 | B1 | 1/2003 | Murray et al. | |
| 6,540,486 | B2 | 4/2003 | Amsler et al. | |
| 6,749,402 | B2 | 6/2004 | Hogan et al. | |
| 6,926,171 | B2 | 8/2005 | Reedy et al. | |
| 6,935,386 | B2 | 8/2005 | Miller et al. | |
| 7,228,879 | B2 * | 6/2007 | Miller et al. | 141/271 |
| 7,243,483 | B2 | 7/2007 | Clüsserath et al. | |

FOREIGN PATENT DOCUMENTS

| | | | |
|---|---|---|---|
| DE | 4110299 | C1 | 2/1993 |
| EP | 0443741 | B1 | 6/1995 |
| EP | 1 559 674 | A1 | 8/2005 |
| GB | 2 060 563 | A | 5/1981 |

OTHER PUBLICATIONS

International Searching Authority, Invitation to Pay Additional Fees, Sep. 9, 2007, 5 Pages.

International Bureau of WIPO, "International Preliminary Report on Patentability", Aug. 12, 2008.

* cited by examiner

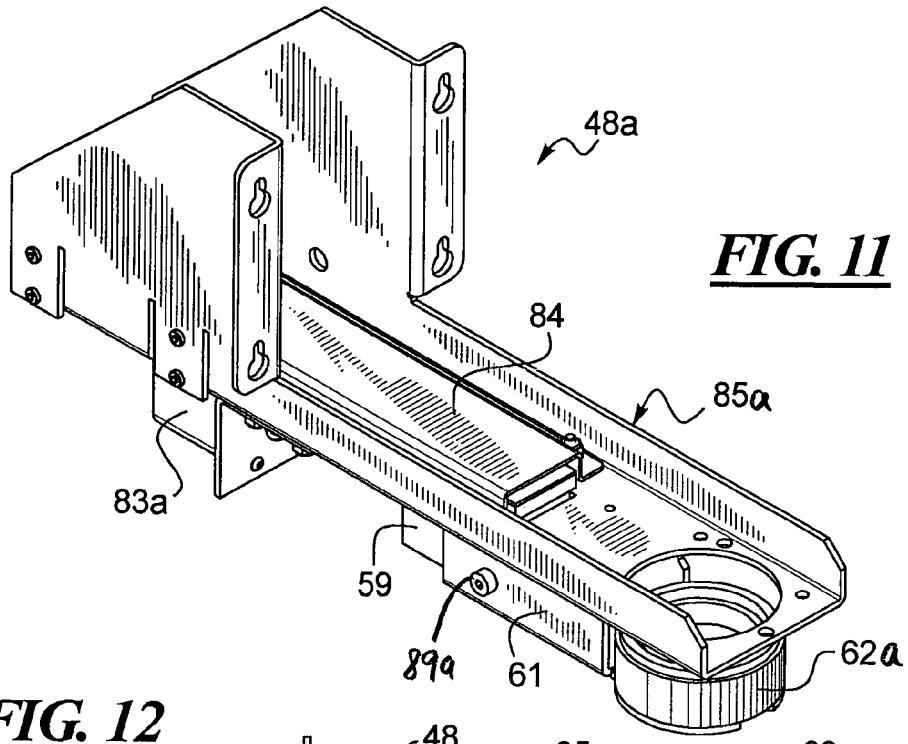
FIG. 11
FIG. 12
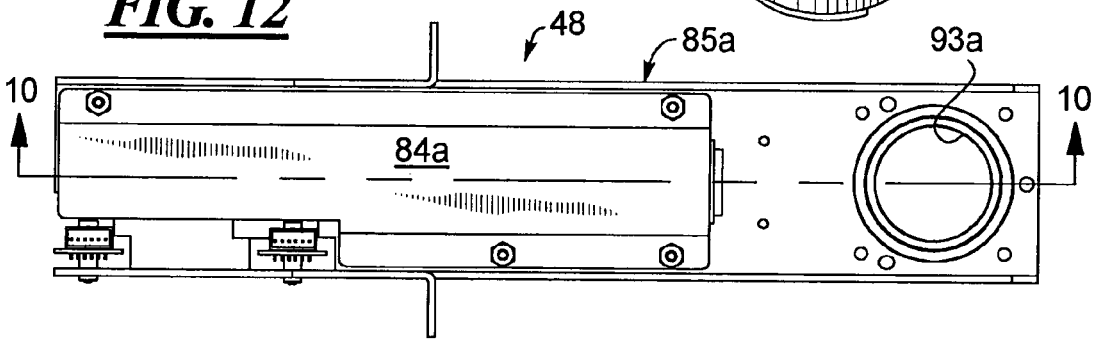
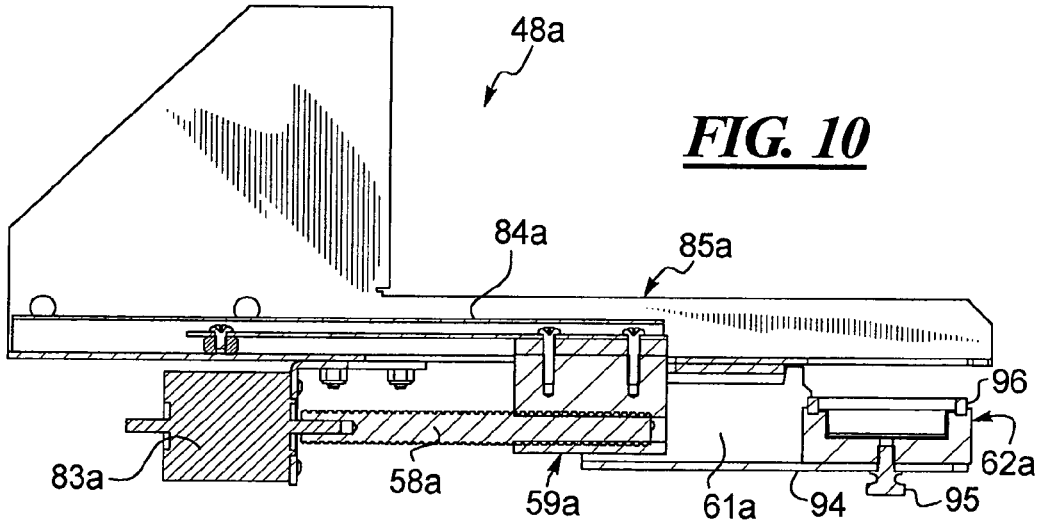
FIG. 10

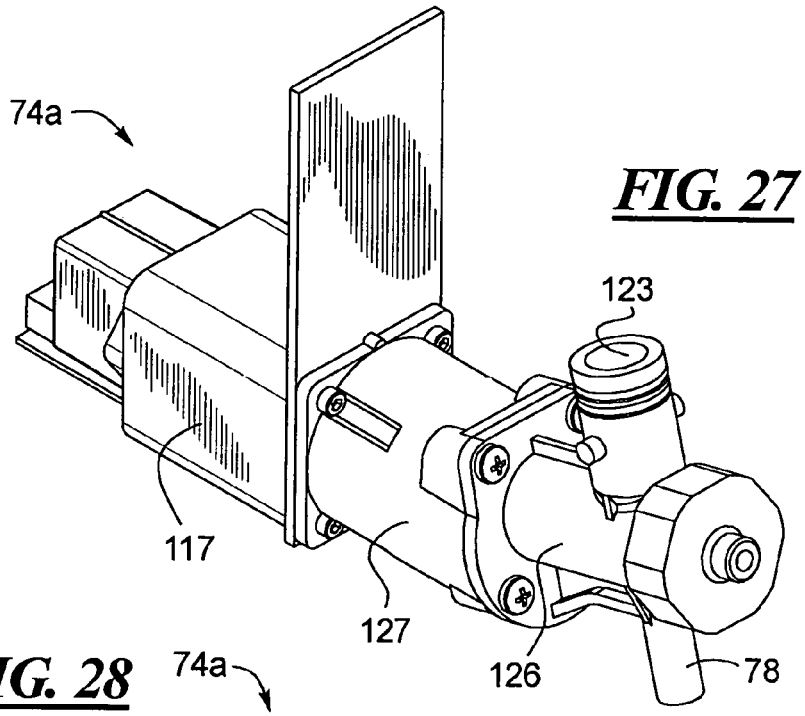
FIG. 27
FIG. 28
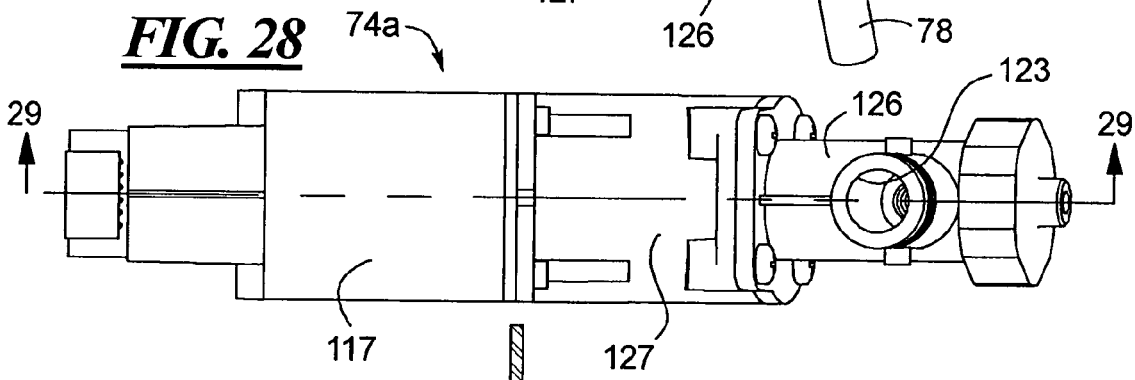
FIG. 29
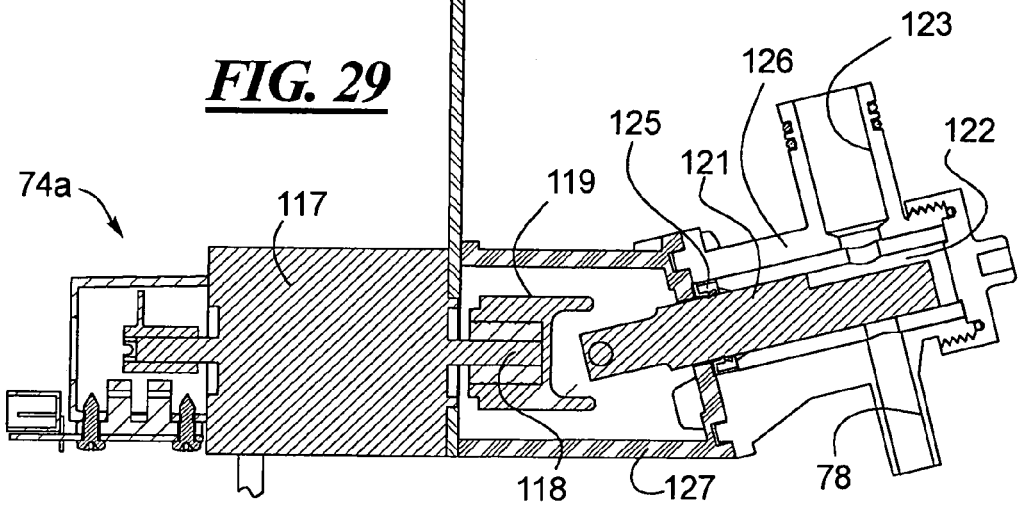

MULTIPLE FLUID DISPENSER

CROSS-REFERENCE TO RELATED APPLICATION

This is a continuation-in-part of application Ser. No. 11/183,192, filed on Jul. 18, 2005, still pending.

BACKGROUND

1. Technical Field

An apparatus is disclosed for dispensing a plurality of fluids according to one of the plurality of formulas stored in a controller. The controller is linked to a coordinating board which, in turn, is linked in series to a plurality of pump modules and a manifold module. Each pump module includes its own module board which controls the operation of two pumps associated with that module. The pump modules, which include the module board, two pumps and two reservoirs as well as motors for driving the pumps, are all mounted on a module frame which is detachably connected to the system so that the modules may be easily changed or replaced. Further, the manifold module may also be easily replaced. The manifold module also includes a motorized closure system of which three embodiments are disclosed herein.

2. Description of the Related Art

Systems for dispensing a plurality of different fluids into a container have been known and used for many years. For example, systems for dispensing paint base materials and colorants into a paint container are known. These paint systems may use twenty or more different colorants to formulate a paint mixture. Each colorant is contained in a separate canister or package and may include its own dispensing pump, e.g., see U.S. Pat. No. 6,273,298, which is commonly assigned with the present application. The colorants and the respective pumps may be disposed on a turntable or along one or more horizontal rows. In a turntable system, the turntable is rotated so that the colorant to be dispensed is moved to a position above the container being filled. In designs using one or more horizontal rows, the container may be moved laterally to the appropriate colorant/pump.

Some currently available paint colorant dispensers utilize nutating pumps and a computer control system to control the nutating pumps. Nutating pumps have a piston which is positioned inside of a housing having a fluid inlet and a fluid outlet. The piston simultaneously slides axially and rotates inside the housing. The dispense stroke or cycle can be broken down into a number of discreet steps or segments for extremely accurate volumetric dispenses. For example, a minimum dispense can be as little as 1/256 of a fluid ounce as illustrated in U.S. Pat. Nos. 6,749,402, 6,540,486 and 6,398,515, all commonly assigned with the present application. These patents all disclose improved nutating pump technologies that are applicable to paint colorant dispensing as well as the dispensing of hair dyes, other cosmetics applications and other fluids.

Systems for dispensing large varieties of different fluids are not limited to paints, but also include systems for dispensing pharmaceutical products, hair dye formulas, cosmetics of all kinds, nail polish, food recipes, etc. Smaller systems for use in preparing products at a point of sale may use a stationary manifold through which a plurality of nozzles extend. Each fluid to be dispensed is then pumped through its individual nozzle. Depending upon the size of the container and the quantity of the fluids to be dispensed, manifolds must be designed in a space efficient manner so that a single manifold can accommodate twenty or more different nozzles. The nozzles are connected to the various ingredients by flexible hoses and the ingredients are contained in stationary canisters or containers.

For example, EP 0 443 741 discloses a formulation machine for preparing cosmetically functional products. The machine includes a plurality of containers for storing various cosmetic ingredients. An input mechanism is provided for entering into a computer specific criteria representative of a customer's needs. A series of instruction sets are then sent from the computer in response to the specific input criteria to a dispensing mechanism.

U.S. Pat. No. 4,871,262 describes an automatic cosmetic dispensing system for blending selected additives into a cosmetic base. A similar system is described in German Patent No. 41 10 299 with the further element of a facial sensor.

Other systems involve a skin analyzer for reading skin properties, a programmable device receiving the reading and correlating same with a foundation formula, and a formulation machine. Components of the formula held in a series of reservoirs within the machine are dosed into a receiving bottle and blended therein. These systems are described in U.S. Pat. Nos. 5,622,692 and 5,785,960. Because the systems disclosed in the '692 and '960 patents suffer from relatively poor precision, nutating pump technology was applied to improve the precision of the system as set forth in U.S. Pat. No. 6,510,366.

In such multiple fluid dispensing applications, both precision and speed are essential. Precision is essential as many formulations require the addition of precise amounts of ingredients. This is true in the pharmaceutical, cosmetic and paint industries as the addition of more or less of a key ingredient can result in a visible change in the color or product or the efficacy of a product.

One way in which the precision of dispensing systems is compromised is "dripping." Specifically, a "leftover" drip may be hanging from a nozzle that was intended to be added to a previous formulation and, with a new container in place under the nozzle, the drop of liquid intended for a previous formulation may be erroneously added to a new formulation. Thus, the previous container may not receive the desired amount of the liquid ingredient and the next container may receive too much.

To solve the drip problem, various scraper and wiper designs have been proposed. However, these designs often require one or more different motors to operate the wiper element and are limited to use on dispensing systems where the nozzles are separated or not bundled together in a manifold. Use of a wiper or scraping function would not be practical in a multiple nozzle manifold design as the ingredients from the different nozzles will be co-mingled by the wiper or scraper which would then also contribute to the lack of precision of subsequently produced formulations.

Another problem associated with dispensing systems that make use of nozzles lies in the dispensing of relatively viscous liquids such as tints, colorants, base materials for cosmetic products, certain pharmaceutical ingredients or other fluid materials having relatively high viscosities. Specifically, the viscous fluids have a tendency to dry and cake onto the end of the nozzles, thereby requiring frequent cleaning in order for the nozzles to operate effectively. While some mechanical wiping or scrapping devices are available, these devices are not practical for multiple nozzle manifold systems and the scraper or wiper element must be manually cleaned anyway.

One solution would be to find a way to provide an enclosing seal around the nozzles or manifold after the dispensing operation is complete. In this manner, the viscous materials being dispensed through the nozzles would have less exposure to air thereby requiring a lower frequency of cleaning operations. To date, applicants are not aware of any attempts other than those set forth in co-pending and commonly assigned U.S. application Ser. No. 10/844,166 (filed May 12, 2004) and Ser. No. 11/183,192 (filed Jul. 18, 2005) to provide any sort of nozzle or manifold closure or sealing element that would protect against drips as well as reducing the frequency in which the nozzle or manifolds must be cleaned.

Another problem associated with the machines described above, is the relative inflexibility of their design. Specifically, machines are either designed for dispensing fluids contained in cylindrical canisters or flexible bags. While some machines may dispense smaller amounts of materials such as tints or colorants from flexible bags and larger quantities of base material or solvent from rigid containers, no currently available machine is able to be easily adapted in the event the packaging for a raw material or an ingredient changes from a bag to a rigid container or vice versa. In short, currently available systems are not easy to modify or adapt to different uses or for dispensing different materials. What is needed is an improved multiple fluid dispensing whereby the pumps, reservoirs containing the fluids to be dispensed, motors and manifolds may be easily changed or replaced so that the machine may be adapted for changing consumer demands.

Accordingly, with the above problems in mind, there is a need for an improved multiple fluid dispensing system that is fast, efficient, that may be easily adapted or modified and that provides an improved cover or drip catcher for the manifold or fluid outlets.

SUMMARY OF THE DISCLOSURE

In satisfaction of the aforenoted needs, an improved dispenser for dispensing a plurality of different fluids is shown and described. One disclosed dispenser comprises a controller that is linked to a coordinator board. The controller has a memory with a plurality of recipes stored therein. The controller board is linked to a first module. The first module is linked in a series to a plurality of other modules, including a plurality of pump modules and at least one manifold module. Each module comprises a module board. Each pump module board is linked to at least one pump. The manifold module board being linked to a motorized closure mechanism. Each pump is then linked between its own reservoir fluid to be dispensed and its own outlet nozzle. The controller, controller board and module boards are all programmed for the simultaneous or sequential pumping of multiple fluids from the reservoirs and through the outlet nozzles in accordance with a recipe selected by the user and retrieved from the memory of the controller.

In a refinement, each pump module further comprises a module frame for supporting its respective module board. Each pump module board is linked to a pair of pumps that are both supported by the module frame. The module frame also supports each pair of reservoirs linked to the pumps and it is the module board that at least partially controls the operation of the pumps as opposed to the controller or coordinator board. Thus, the disclosed dispenser has a decentralized and modular control system.

In another refinement, the disclosed system comprises housing cabinetry designed in such a way that each module, i.e., pump module or manifold module, is detachably connected to the cabinetry so that each module may be easily exchanged or replaced. Further, the cabinetry is also preferably designed so that additional modules may be added (or subtracted) easily.

In a further refinement of this concept, the disclosed dispenser comprises from 6 to 16 modules for simultaneous dispensing of from 12 to 32 different fluids. In other embodiments, less than 12 different fluids may be dispensed and more than 32 fluids may be dispensed.

In another refinement, each pump is connected to its respective outlet nozzle by a flexible hose and each outlet nozzle is mounted within a manifold or a manifold block, located in the manifold module. In a further refinement, the manifold is supported within a manifold housing which is also modular in design and which may be detachably connected to the cabinetry.

The manifold may be a compact block or array of nozzles for use with a stationary container, or the manifold may comprise a plate that supports the nozzles in a line (i.e., linear nozzle plate) or circle (i.e., round nozzle plate) for systems that move the container between nozzles for sequential dispensing. Various manifold designs are anticipated.

In a further refinement of this concept, each outlet nozzle of the manifold faces downward. In a further refinement, the manifold housing also is connected to a closure mechanism or cover for the manifold and nozzles. The closure mechanism comprises a motor linked to a manifold board which, in turn, is linked in series to the modules.

In a further refinement of the manifold and nozzle closure concept, the manifold and nozzle closure system comprises a manifold for supporting a plurality of downwardly extending nozzles, and a motor connected to an actuator. The motor is disposed rearwardly from the manifold and the actuator is directed towards the manifold. The actuator is pivotally coupled to a drip catcher. The drip catcher comprises a front end that is connected to a container holder. The actuator, drip catcher and container holder all being movable by the motor between (1) a closed position where the drip catcher is disposed beneath the manifold and nozzle so the drip catcher serves as a bottom cover for the nozzles and where the container holder is disposed in front of the manifold, and (2) one or more open positions where the container holder is disposed beneath one or more of the nozzles and where the drip catcher has been moved pivotally downward and rearward relative to the initial closed position.

In a further refinement of this embodiment, the actuator is a threaded drive shaft that is threadably coupled to a slide block. The slide block is pivotally coupled to the drip catcher.

In a further refinement of this concept, the system comprises a catch and an abutment. The drip catcher and container holder pivot upward to the closed position when the catch engages the abutment as the drive shaft is rotated to move the slide block, drip catcher and container holder forward to the initial closed position.

In an embodiment, the manifold may comprise an elongated plate where the nozzles are accommodated in the plate and aligned in a single row, a single staggered row or a single row of nozzles arranged in clusters.

In an alternative embodiment, where the container mouth or neck is wide, the nozzles may be accommodated in a closely spaced arrangement within a round manifold or manifold block. In another refinement, the drip catcher comprises an upwardly facing rim that can sealingly engage an underside of the manifold.

In another embodiment, the manifold enclosure system further comprises a proximity sensor disposed in front of the manifold to detect the presence of a container in the container holder when the drip catcher is in the closed position.

In another refinement, the container holder is detachably connected to the front end of the drip catcher so the container holder can be exchanged or modified to accommodate containers of varying sizes and configurations.

In another refinement, a connecting block is disposed beneath and connected to the slide block. The connecting block connects the slide block to a bracket assembly. The connecting block is pivotally connected to the drip catcher by the bracket assembly.

In another refinement, a supporting frame is used to support the manifold, motor and provided a track for movement of the slide block. The abutment used to pivot the drip catcher and container holder upward to the initial closed position may be disposed on an underside of the supporting frame while the catch may be disposed on the bracket assembly.

In another refinement, the downward pivotal movement of the container holder and drip catcher away from the manifold as the system moves from the initial closed to an open position may be provided by the force of gravity after the catch moves rearward away from the abutment.

In an refinement, the manifold or elongated nozzle plate serving as a manifold may be connected to the supporting bracket.

In a similar refinement, the closure mechanism comprises a supporting frame connected to a motor. The motor is connected to a threaded drive shaft. The drive shaft is directed towards the outlet end of the manifold block. The drive shaft is threadably coupled to a slide block. The slide block is slidably supported by the supporting frame. The slide block is also pivotally connected to a bracket. The bracket is connected to an upwardly facing drip catcher. The bracket comprises a catch for engaging an abutment that pivots the bracket and drip catcher upward towards the outlet end of the manifold block as the drip catcher and bracket approach the manifold block when the drive shaft is rotated to move the slide block, bracket and drip catcher towards the manifold block.

In a another refinement of the nozzle closure mechanism, each outlet nozzle is connected to an elongated plate, either in a straight row, a staggered relationship or in suitable small groupings. The nozzles face downward. The manifold housing also is connected to a closure mechanism disposed below the nozzles and the elongated plate. The closure mechanism comprises a motor linked to a manifold board which, in turn, is linked in series to the various ingredient modules. A bottle holder is also linked to the motor. The motor moves the bottle holder and bottle beneath the nozzles and stops the bottle holder/bottle at desired locations so the various ingredients may be dispensed into the bottle. The ingredients may be dispensed one at a time or more than one ingredient at a time, depending upon bottle size, nozzle arrangement and nozzle size.

In a different refinement, the reservoir of at least one module comprises a vertical canister while the reservoir at least one other module comprises a flexible bag. In a further refinement, one module may include a pair of vertical canisters and another module may include a pair of flexible bags.

Because of the modular design, the pumps of the various modules may be different from that of the other modules. Therefore, the pumps of the various modules may be selected from the group consisting of nutating pumps, gear pumps, piston pumps and combinations thereof as the pump of one module may be different from the pump of another module. Or, for modules designed with a pair of pumps, the pair of pumps of one module may be different from the pair of pumps of another module. In still a further, albeit less preferred refinement, a single module may include two different types of pumps and two different types of reservoirs.

In a different refinement, when a vertical hard-shell reservoir is utilized, such a reservoir may be designed so that an upper portion of the vertical reservoir has a square cross-section and a lower portion of the reservoir has a round cross-section. The upper square cross-section provides larger volumes when two reservoirs are supported next to each other and the lower round cross-section enables the reservoir to be more efficiently drained so that less fluid is wasted.

The closure system described above may also be utilized on different fluid dispensers.

The disclosed dispenser can be designed for simultaneously dispensing a plurality of fluids for a faster dispense.

BRIEF DESCRIPTION OF TIIE DRAWINGS

For a more completer understanding of this disclosure, reference should now be made to the embodiments illustrated in greater detail in the accompanying drawings, wherein:

FIG. 10 is a side sectional view of the closure mechanism taken along line 10-10 of FIG. 12;

FIG. 11 is a perspective view of the closure mechanism shown in FIGS. 9 and 10;

FIG. 12 is a top plan view of the closure mechanism shown in FIGS. 9-11;

FIG. 27 is a perspective view of a nutating pump that can be used with the disclosed dispensing system;

FIG. 28 is a top plan view of the pump shown in FIG. 27;

FIG. 29 is a sectional view taken substantially along the line 29-29 of FIG. 28.

Figure 34:
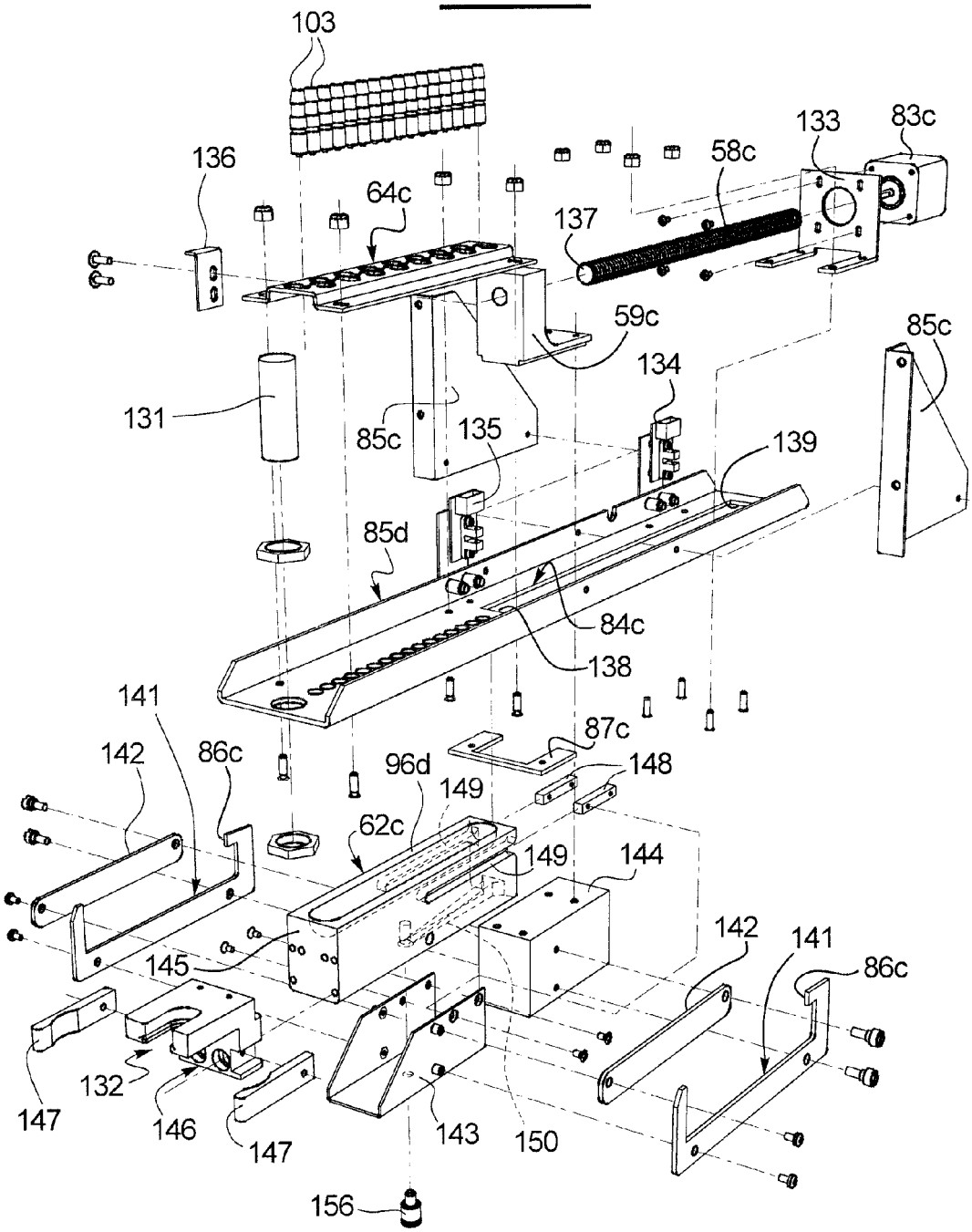
FIG. 34 is an exploded view of the closure mechanism module shown in FIG. 31.
Figure 35:
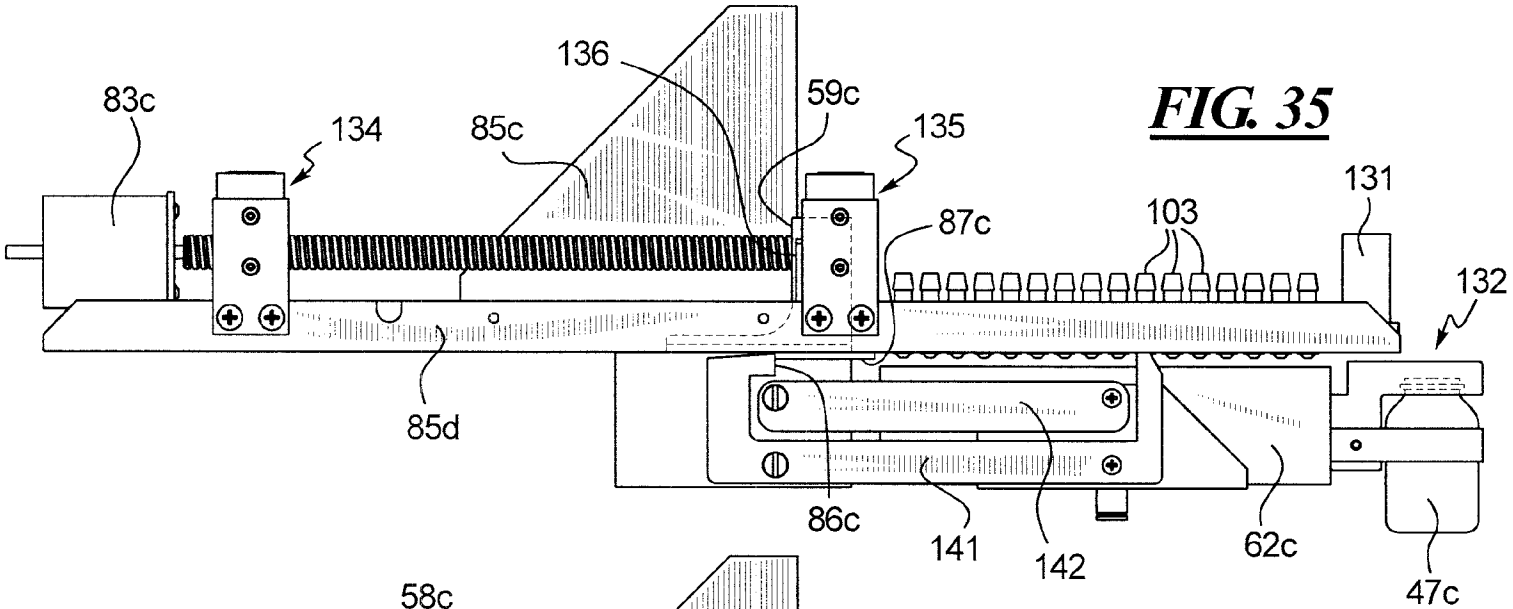
FIG. 35 is a side plan view of the closure mechanism shown in FIG. 31 illustrating the mechanism in an initial closed position with the drip catcher abuttingly engaging the bottom of the frame and the container holder and container disposed in a front position where they can be sensed by the sensor.
Figure 36:
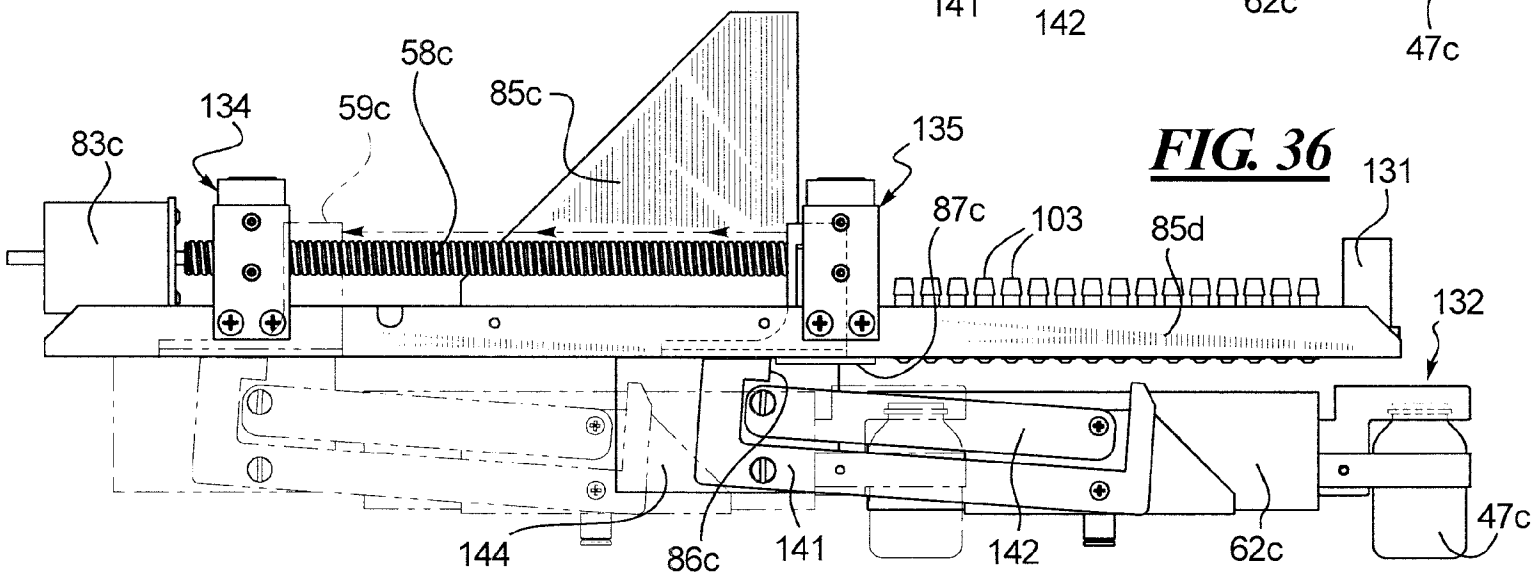
Figure 37:
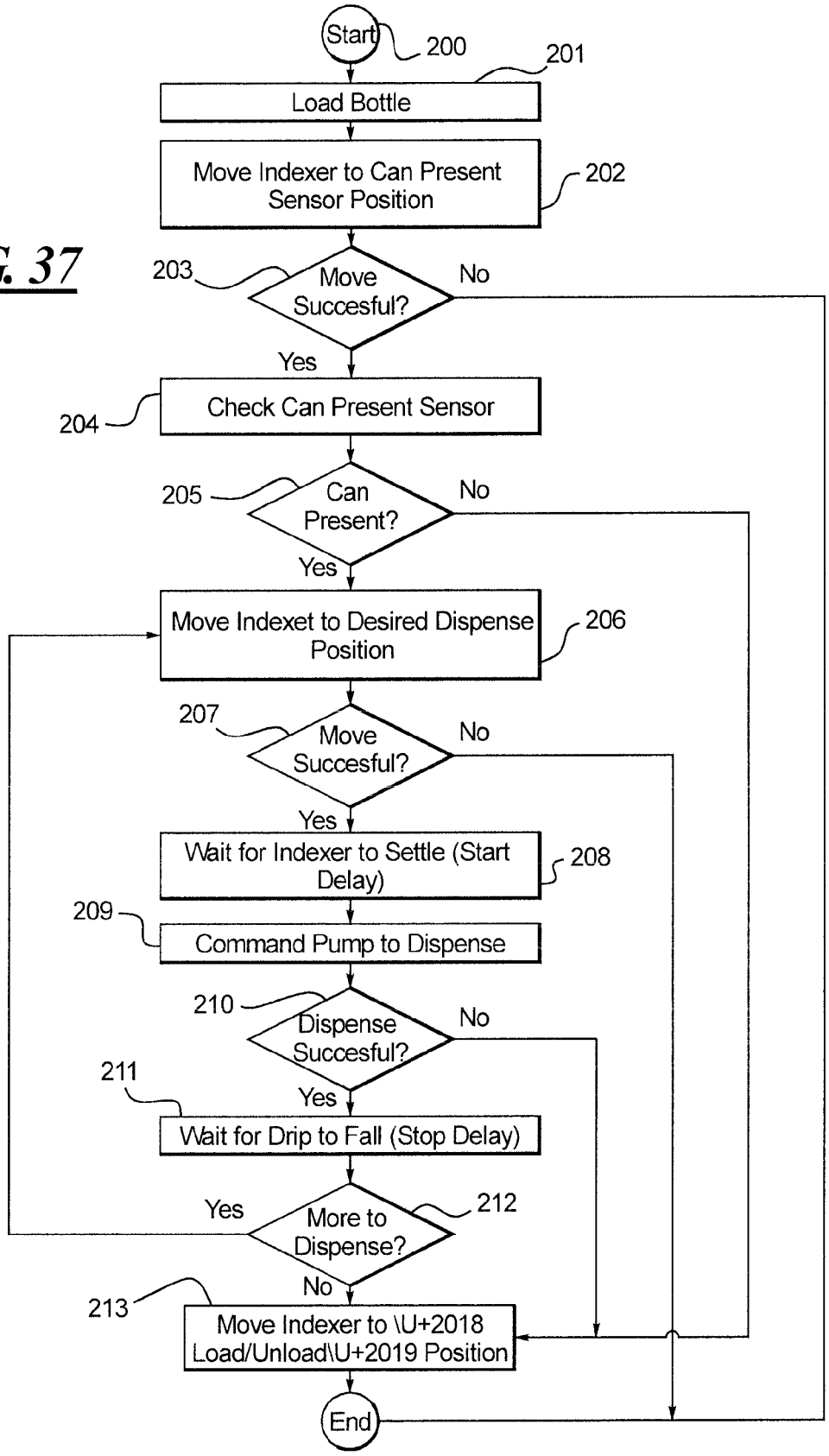

FIG. 36 is another side plan view of the closure mechanism shown in FIG. 31 but with the container holder, container, drip catcher and bracket assembly pivoted downward from the initial closed position shown in FIG. 35 to an open position (solid line) and further with the container, container holder, drip catcher and bracket assembly being moved rearward to another open dispensing position (shown in phantom) where the container is disposed below one of the nozzles and ready to receive fluid; and FIG. 37 is a flow diagram illustrating an algorithm or method for moving a container between nozzles of a manifold system where the container must be moved between nozzles for a sequential dispensing like the manifold closure system shown in FIGS. 31-36.

It should be understood that the drawings are not necessarily to scale and that the embodiments are often illustrated by graphic symbols, phantom lines, diagrammatic representations and fragmentary views. In certain instances, details have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Figure 1:
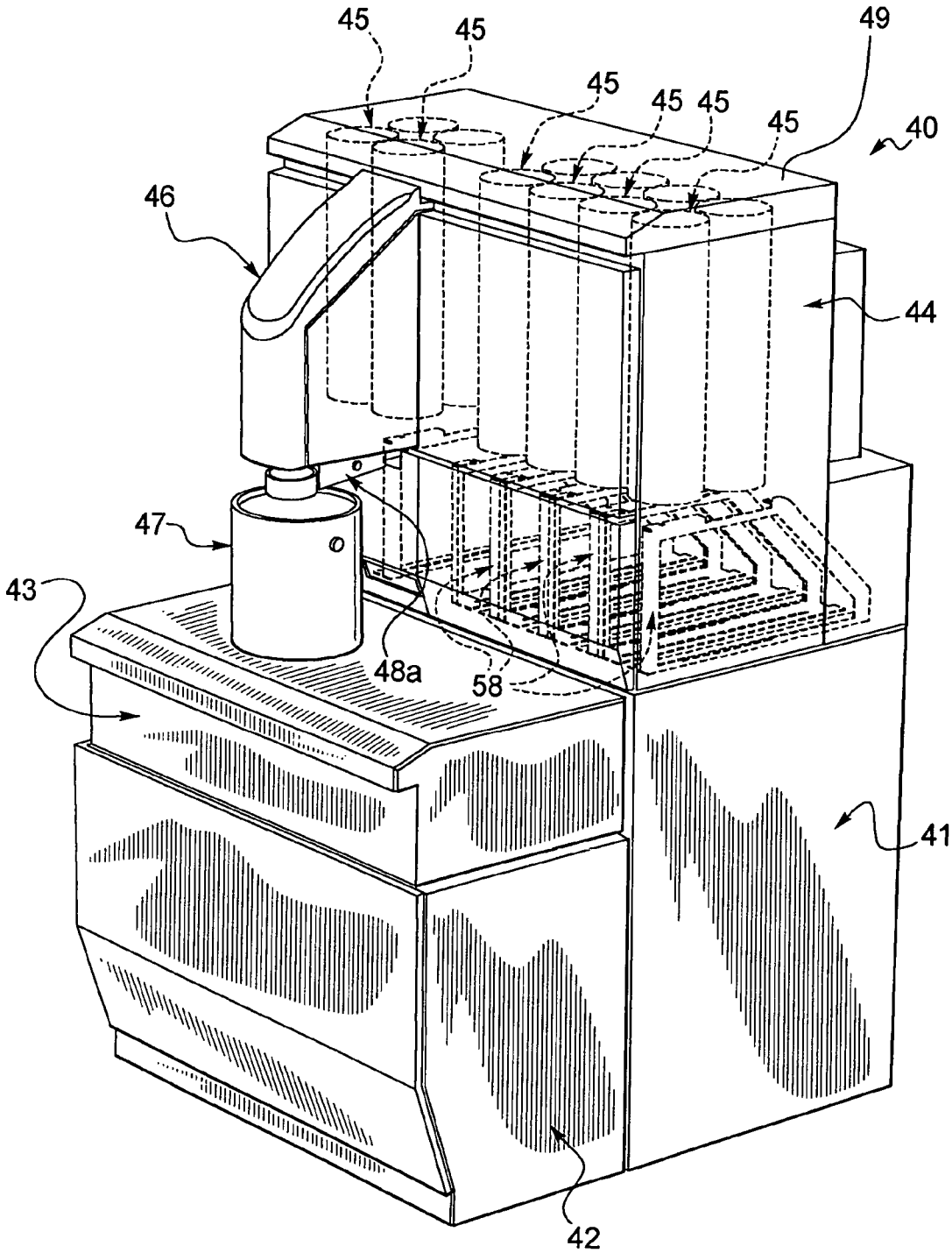
FIG. 1 is perspective view of a disclosed fluid dispensing apparatus.

FIG. 1 discloses a dispensing apparatus 40 which includes a lower base portion 41 connected to a front cabinet 42 which, in turn, is disposed beneath in support a middle cabinet shown at 43. The middle cabinet 43 may also include a scale or weighing function (not shown). Any one of the cabinets 41 through 43 may house a controller and other electronic equipment (not shown). The cabinet 41 supports an upper cabinet 44 which, in turn, houses a plurality of modules which are represented by pairs of canisters shown generally at 45. In the examples shown in FIG. 1, six modules that each dispense two different fluids are shown for a total dispending of 12 different fluids. FIG. 1 also illustrates a manifold module 46 which will be described below. The sequential or, preferably simultaneous dispensing of one or more fluids from the 12 difference fluids provided in FIG. 1 is made through the manifold module 46 and down into the container 47. A manifold closure system is shown at 48*a*.

Figure 2:
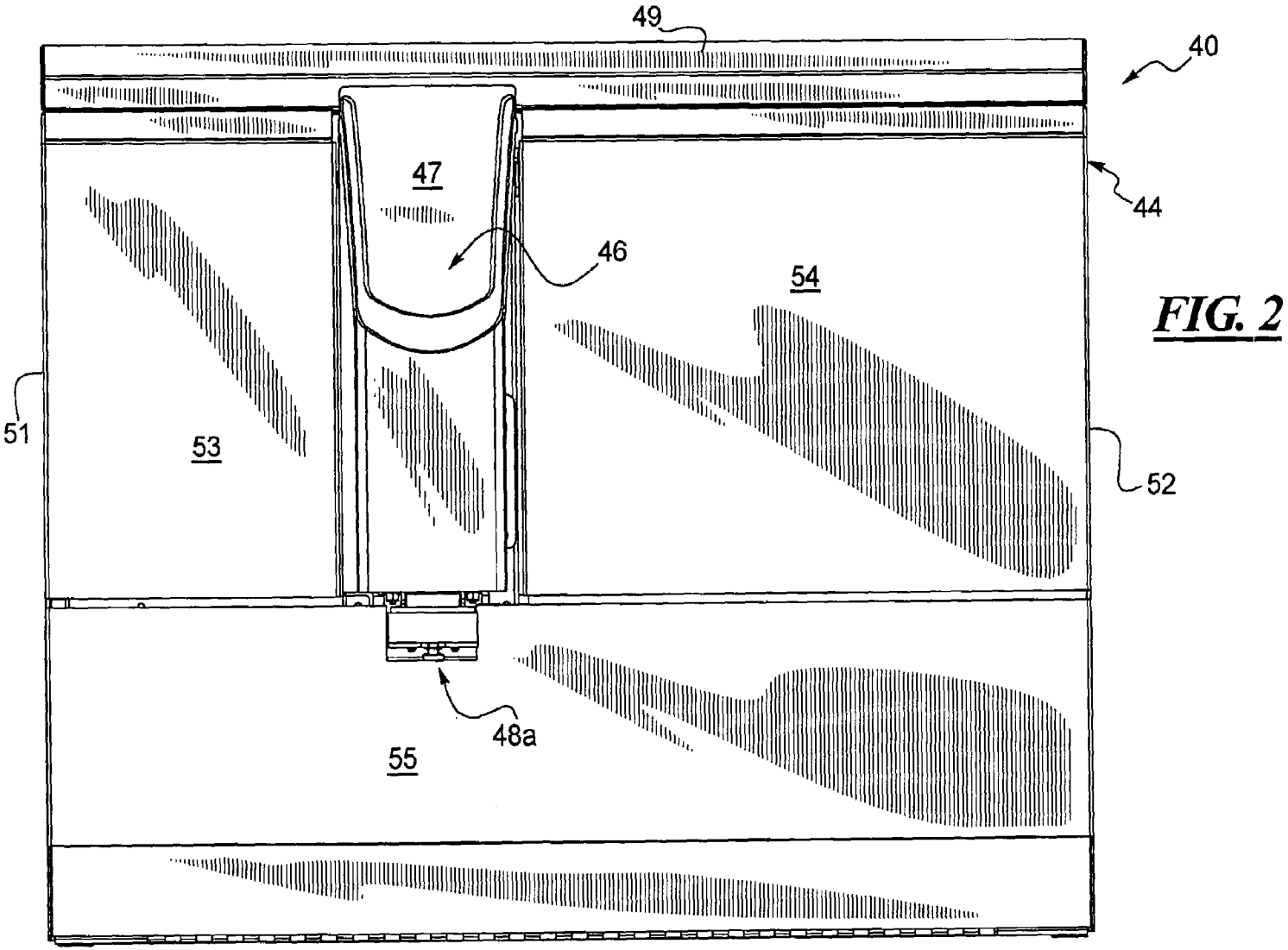
FIG. 2 is a front plan view of the fluid dispensing apparatus shown in FIG. 1.
Figure 3:
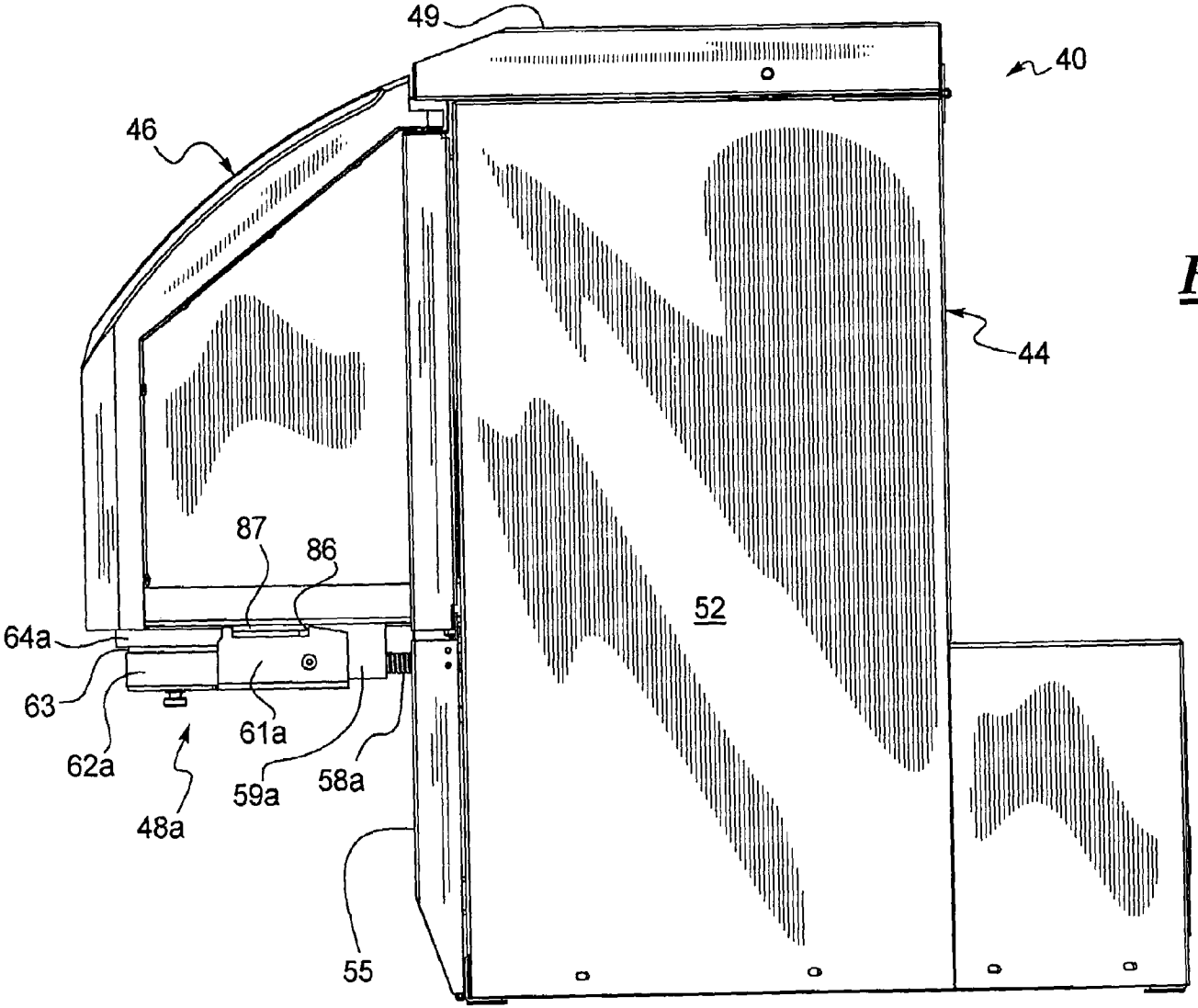
FIG. 3 is a right side elevation view of the fluid dispensing apparatus shown in FIGS. 1 and 2.

Turning to FIGS. 2 and 3, the upper cabinet 44 includes a cover 49 as well as side panels 51, 52. The cabinetry 44 also includes separate front panels 53, 54 which serve as aesthetic covers for the modules shown in FIG. 1. Lower panels 55, 56 provide access to the module brackets and related components shown at 58 in FIG. 1.

The cabinet 44 is designed so that the manifold module 46 may be easily removed and replaced. The manifold module 46 includes a housing 47 and side supporting brackets as shown in FIG. 3. Also shown in FIG. 3 is the manifold closure mechanism 48*a* which will be described in greater detail below. However, it will be noted that the mechanism 48*a* includes a threaded drive shaft 58*a*, slide lock 59*a*, a bracket 61*a* and a drip catcher 62*a*. The drip catcher 62*a* may include a resilient ring 63 for sealingly engaging the manifold block 64*a*. The intricacies of the closure mechanism 48*a* will be described in greater detail below in connection with FIGS. 9-13 and alternative embodiments 48*b*, 48*c* will be described in connection with FIGS. 14-16 and FIGS. 31-37.

Figure 4:
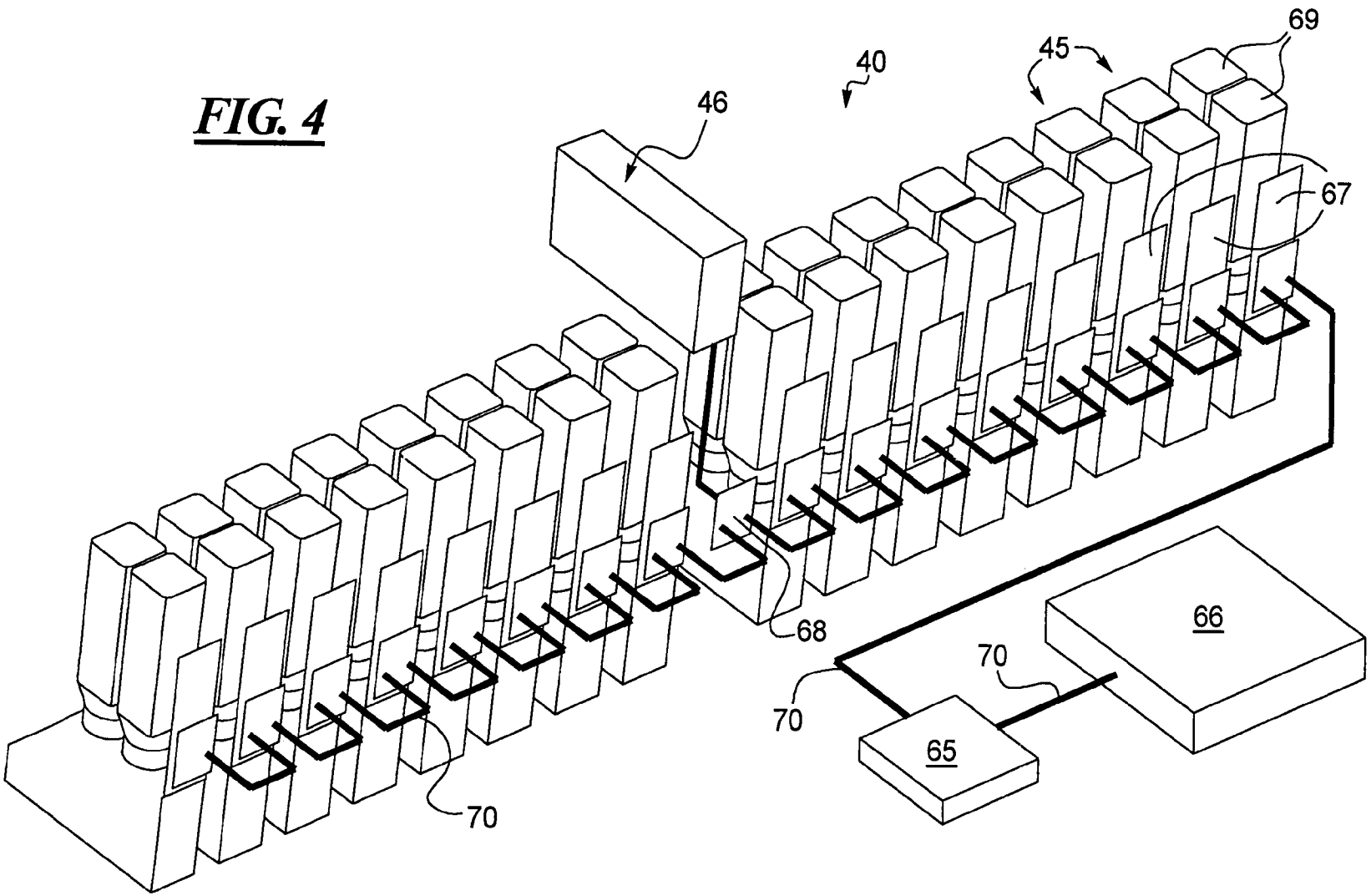
FIG. 4 is a schematic perspective view of sixteen two-pump, two-reservoir modules linked together in series with a coordinator board, controller and manifold in accordance with this disclosure.

FIG. 4 is a schematic illustration of the dispense system 40 showing 16 different modules 45 with two pumps and two reservoirs each along with a manifold module 46, all connected in series to a coordinator board 65 and a controller 66. In the modular design shown in FIG. 4, three different boards are utilized; the coordinator board 65, the module boards 67 and the manifold board 68. The main function of the manifold board 68 is to operate the manifold closure mechanisms 48*a*, 48*b*, 48*c*, (see FIGS. 1-3, 9-16 and 31-37). The coordinator board 65 is the link between the PC or controller 66 and the module boards 67. The module boards 67, in the embodiment shown in FIG. 4, control two motors for pumping fluids from the pair of reservoirs of each module. Thus, each module 45 includes two reservoirs 69 and two pumps (not shown in FIG. 4) with each pump being assigned to its own reservoir 69.

The boards 65, 67 and 68 are preferably designed to share a certain common features. Such common features include the use of a common microchip series processor (e.g., a PIC18F processor), an on board power supply, a silicon serial number chip, and SIM (subscriber identify module) card socket, a stepper motor driver chip, an encoder, a DAC (digital to analog converter) chip, a CAN (controller area network) bus (preferably with RJ12 connectors), indicator LEDs (light emitting diodes), a serial debug connector and a reset switch with remote reset capability.

More specifically, one example of a coordinator board 65 includes a microchip PIC18LF8680 clocked at 20 MHz, a four quart USB (universal serial bus) hub with one port dedicated to the coordinator and three ports for general usage, an USB power control chip, high power ports, VDC converters, a single CAN port with termination resistor and additional separate CAN port with termination resistor in the form of microchip MCP2515, a FTDI FT245B USB chip, an external flash memory, preferably AMD AM29LV800DT chip, an external RAM (random access memory), preferably in the form of an ALLIANCE AS7C4O98A chip, a SIM card socket, a silicon serial number chip, preferably in the form of DALLAS DS2436 chip, indicator light admitting diodes, a reset switch with an optically isolated external input, an optically isolated abort switch input, a connector for a microchip ICD2 in-circuit debugger, and a serial port for program development usage. These exemplary parts, of course, may be modified or substituted for.

The module board 67, in a preferred embodiment, controls two bipolar stepping motors which will be described in greater detail below. One preferred module board 67 includes a PIC18F6680 microchip clocked at 40 MHz, VDC switching regulators, a CAN transceiver with dual CAN connectors, a SIM card socket, a silicon serial number chip, preferably in the form of DALLAS DS2436 with provisions for additional chips, two 8-bit DACs for setting the drive/run current for the stepper drives, two ALLEGRO microstepping driver chips, two quadrature encoder chips, two index interface circuits, two counters for quadrature encoder chips, indicator light admitting diodes, a reset switch with optically isolated external input, a connector for a ICD2 microchip in dash circuit debugger, a serial port for program development usage and two optically isolated motor driver circuits with an over current fuse. These exemplary parts, of course, may be modified or substituted for.

The module board 68 controls a single bipolar stepping motor and other features needed to control the nozzle closure mechanism 48. One exemplary manifold board 68 includes a PIC18F6680 microchip clocked at 40 MHz, VDC switching regulators, a CAN transceiver dual CAN connectors, a SIM card socket, a silicon serial number chip, preferably in the form of DALLAS DS2436 with provisions for additional chips, one or more 8-bit DACs for setting drive/run current for the stepper drive, and ALLEGRO microstepping driver chip, a quadrature encoder chip, an index interfacing circuit, counters for the quadrature encoder chip, indicator light admitting diodes, a reset switch with an optically isolated external input, a connector for a ICD2 microchip in dash circuit debugger, a serial port for development usage, dual mechanical or optical limit switch interface circuits, an optically isolated CAN sensor interface circuit and a pulsed high current LED located control. These exemplary parts, of course, may be modified or substituted for.

As shown in FIG. 4, the controller, coordinator board 65 and module board 67 of the various modules, along with the manifold board 68 of the manifold module 46 are all connected in series, using easy-to-obtain phone lines or patch cables 70.

The controller 66 includes a graphical user interface (GUI) that enables a user to select a recipe or formula and a quantity for dispensing. The controller 66 also includes an application program interface (API), an encoding/decoding program referred to as a machine control driver (MCD) which is preferably a DVX application, an interface controller (IFC) for packing commands and a communications driver for sending serial commands to the coordinator board 65, preferably through a USB port.

The coordinator board 65 receives commands from the controller 66 through a complimentary USB port. The coordinator board 65 includes its own communications driver for receiving the commands, its own IFC for unpacking the commands received from the controller 66 and its own real time operating system (RTOS) and API. Hardware devices of the coordinator board 65 also preferably include a general purpose timer, a serial number chip, a subscriber identification module (SIM), an electrically erasable programmable read only memory (EEPROM), a debug port, LED pins, a debug LED pin, and a control area network (CAN) port.

To begin dispensing, the coordinator board 65 will preferably send a message down the line of module boards 67 to stop agitating. The multiple fluid and quantity dispense message received from the PC 66 will then be parsed into individual messages, i.e. separate messages for each ingredient, and sent, preferably one at a time, down the line of modules boards 67 (and manifold board 68) as shown in FIG. 4. The individual ingredient dispense messages sent by the coordinator board 65 to the module board 67 linked to the coordinator board 65 are packaged by a protocol packaging driver as a part of a control area network (CAN), then sent by a communication driver out a CAN port to a complimentary CAN port on the module board 67.

Each module board 67 receives messages either directly from the coordinator board 65 if the module board 67 is linked to the coordinator board 65, or more often, from the preceding module board 67 in the chain, through its own CAN port. Like the coordinator board 65, module boards 67 and manifold board 68 include a general purpose timer, a serial number chip, a subscriber identification module (SIM), an electrically erasable programmable read only memory (EEPROM), a debug port, LED pins, a debug LED pin, and a control area network (CAN) port. Each board 67 also includes one or more digital to analog converter chips (DAC), stepper drive chips, sensor pins, agitation pins and other LED pins.

Each module board 67 has its own communication driver for receiving each message, a protocol packaging driver for unpacking the message and a RTOS. The identification hardware and applications of each board 67, 68 enable the board 67 or 68 to identify if the message is intended for one of its pumps or, in the case of the manifold board 68, the motor used to open or close the closure mechanism 48*a*, 48*b* or 48*c*. When the message is intended for another board 67 or 68 down the line, the message is sent out through the CAN port.

When a message needs to be acted on by a board 67, the a message from the protocol packaging driver is sent by the RTOS and API of the board 67 through pump logical device application to a stepper drive driver. The stepper drive driver sends and on/off signal through a digital to analog converter (DAC) to the DAC chip, a forward signal to the stepper drive chip, and a signal indicative of the number of steps or pulses need to a discrete I/O driver. Signals are sent back to the coordinator board 65 that the operation has been completed or not completed. Agitation is preferably stopped before a dispense is commenced. The manifold board 68 is somewhat similar but simplified because it includes a stepper motor to open or close the mechanism 48*a* (FIG. 9-13), 48*b* (FIGS. 14-16) or 48*c* (FIGS. 31-17.

Figure 5:
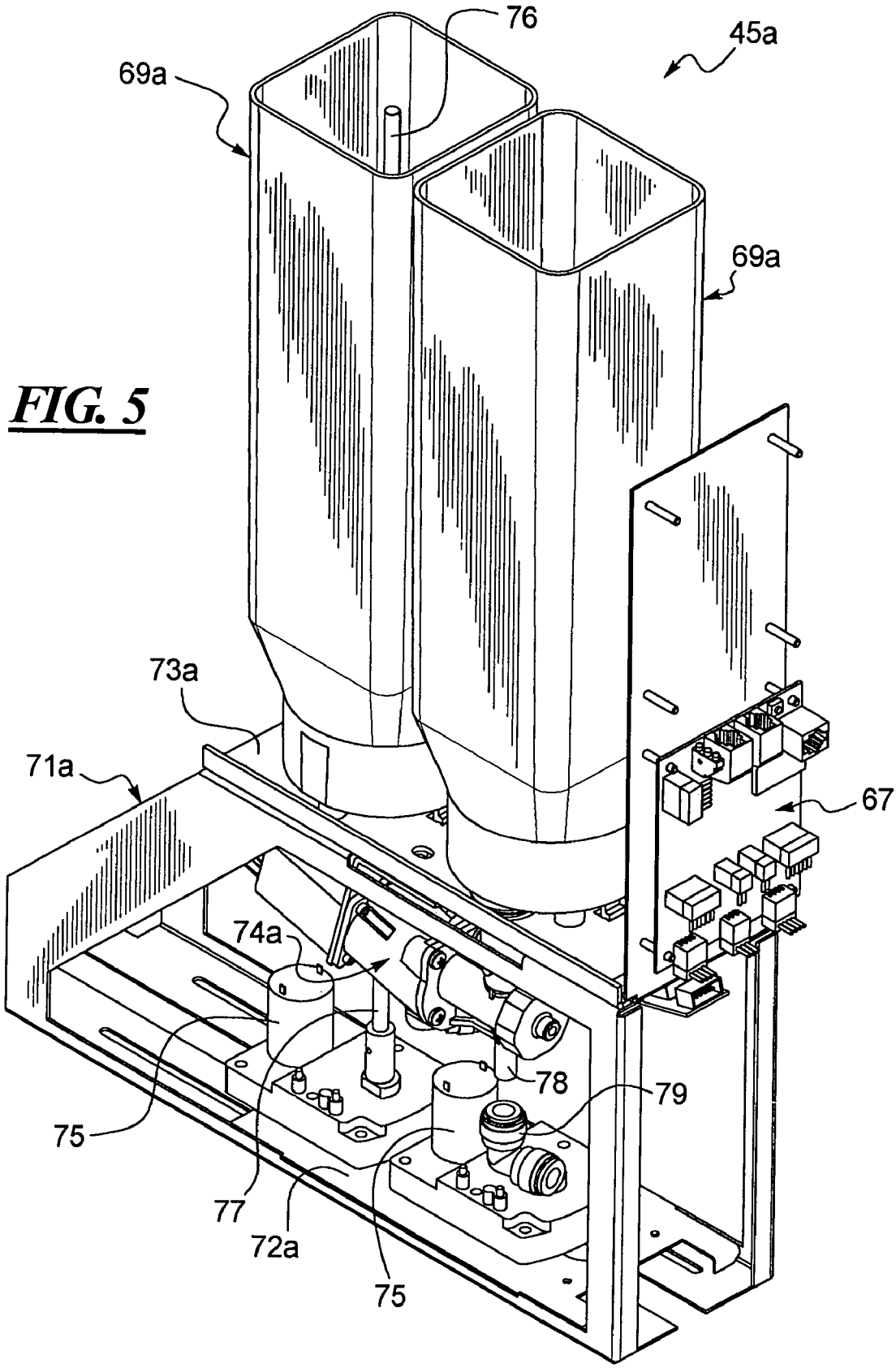
FIG. 5 is a perspective view of a module with two disclosed vertical canisters.
Figure 6:
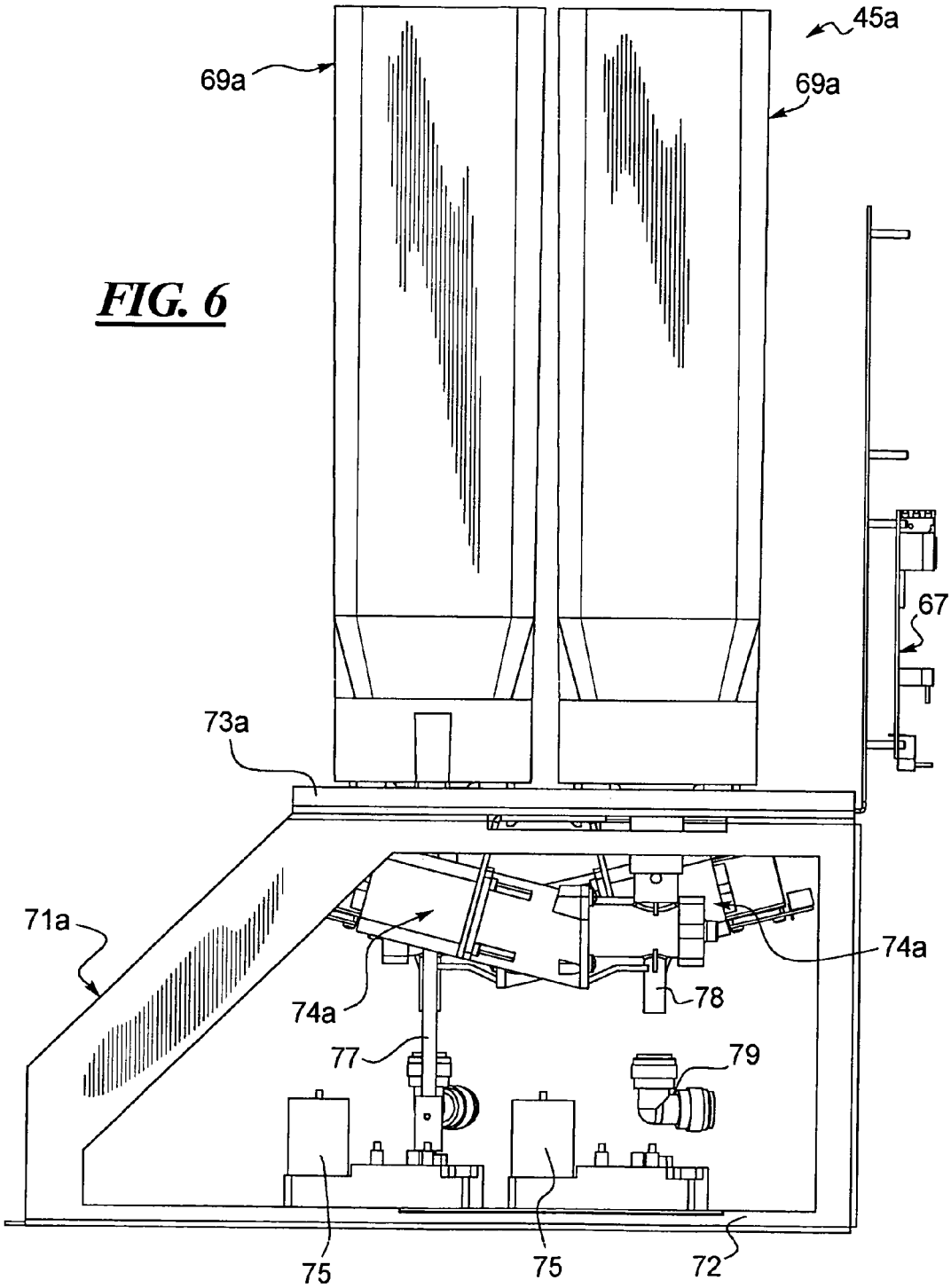
FIG. 6 is a left side plan view of the module shown in FIG. 5.

Turning to FIGS. 5 and 6, a module 45*a* is shown which includes vertical hard-shell canister 69*a* which will be further described in connection with FIGS. 20-23 below. The canisters 69*a* are supported by a module frame 71*a* which includes a lower base 72*a* that is slidably received into the upper portion of the cabinet 44 as shown in FIG. 1. The frame 71*a* also includes an upper portion 73*a* that supports the canisters 69*a* and also supports two pumps shown at 74*a* in FIGS. 5 and 6.

Each pump 74*a* is linked to one canister 69*a*. The pumps 74*a*, in turn, are linked to the manifold block 64 (see FIG. 3) or nozzle plate (see FIGS. 32-34) and, the operation of each motor 74 is controlled by the module board shown at 67. The module board 67 may also control the motors shown at 75 which rotate the agitator paddles 76 shown in FIGS. 24 and 25. The use of the agitator paddles 76 are often needed as the fluid being dispensed from the canisters 69*a* can be very viscous and undue waste would result if the agitator paddles 76 were not utilized on a periodic or timed basis. As shown in FIGS. 5 and 6, the agitator motor 75 is linked to a drive shaft 77 which, in turn, rotates the paddle 76 (see also FIGS. 24 and 25). FIGS. 5 and 6 also illustrate an outlet 78 of a fluid pump 74*a* and an elbow nozzle 79 for connecting the outlet 78 to a hose leading to the manifold 46.

Figure 7:
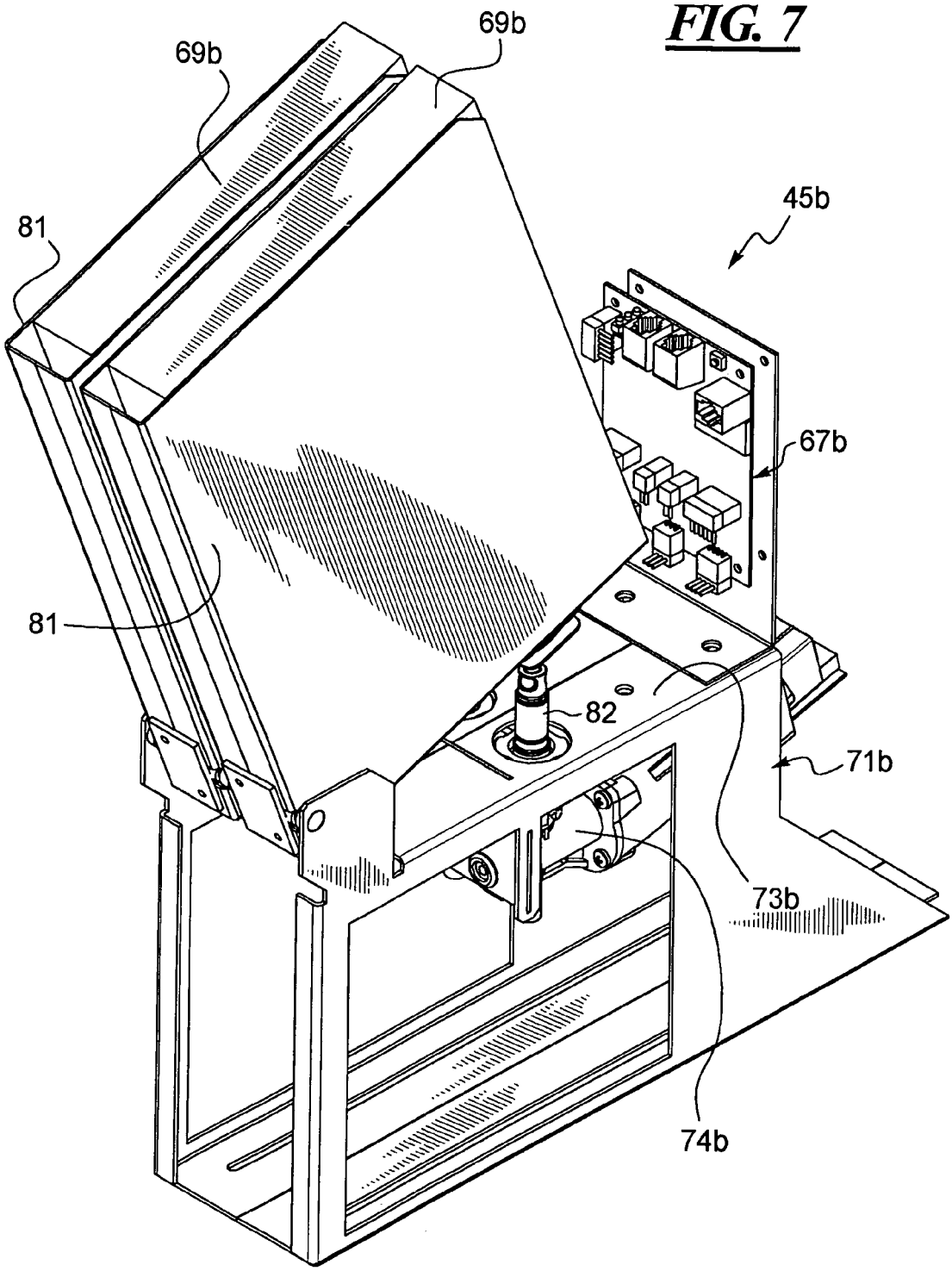
FIG. 7 is a perspective view of a module with two flexible bag reservoirs made in accordance with this disclosure.
Figure 8:
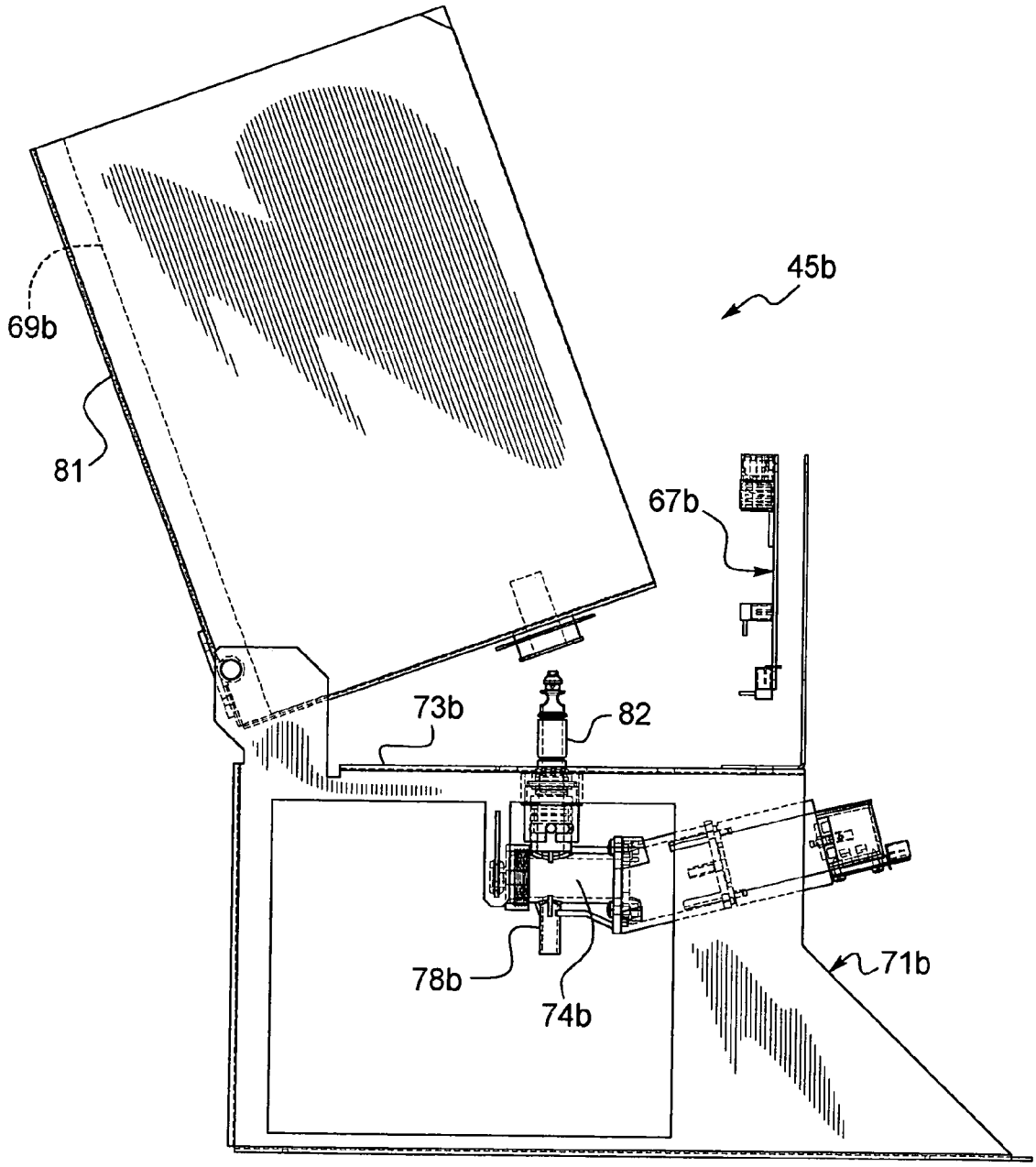
FIG. 8 is a right side elevational view of the module shown in FIG. 7.

The module 45*a* shown in FIGS. 5 and 6 are particularly suitable for upright hard-shell vertical canisters such as those shown at 69*a* in FIGS. 5 and 6. In contrast, FIGS. 7 and 8 illustrate a module 45*b* whereby the hard-shell vertical canister 69*a* has been replaced with flexible bags shown at 69*b*.

The bags 69*b* are supported in sleeves 81 which, in turn, are pivotally connected to the module bracket 71*b*. The upper portion 73 of the bracket 71*b* also supports two motors 74*b* which, in turn, are controlled by the module board 67*b*. The pumps 74*b* are connected to the bags 69*b* by specially designed nozzles 82 which are further illustrated below in connection with FIG. 26. The module frame 71*b* can be easily slide in and out of the cabinetry 44 of the fluid dispenser 40, in a manner similar to the module frame 71 illustrated in FIGS. 5 and 6. Thus, the modules 45*a* and 45*b* are interchangeable and one dispensing system 40 may include vertical canister modules 45*a* and flexible bag modules 45*b*. The module boards 67, 67*b* all communicate with each other and with the coordinator board 65.

Figure 9:
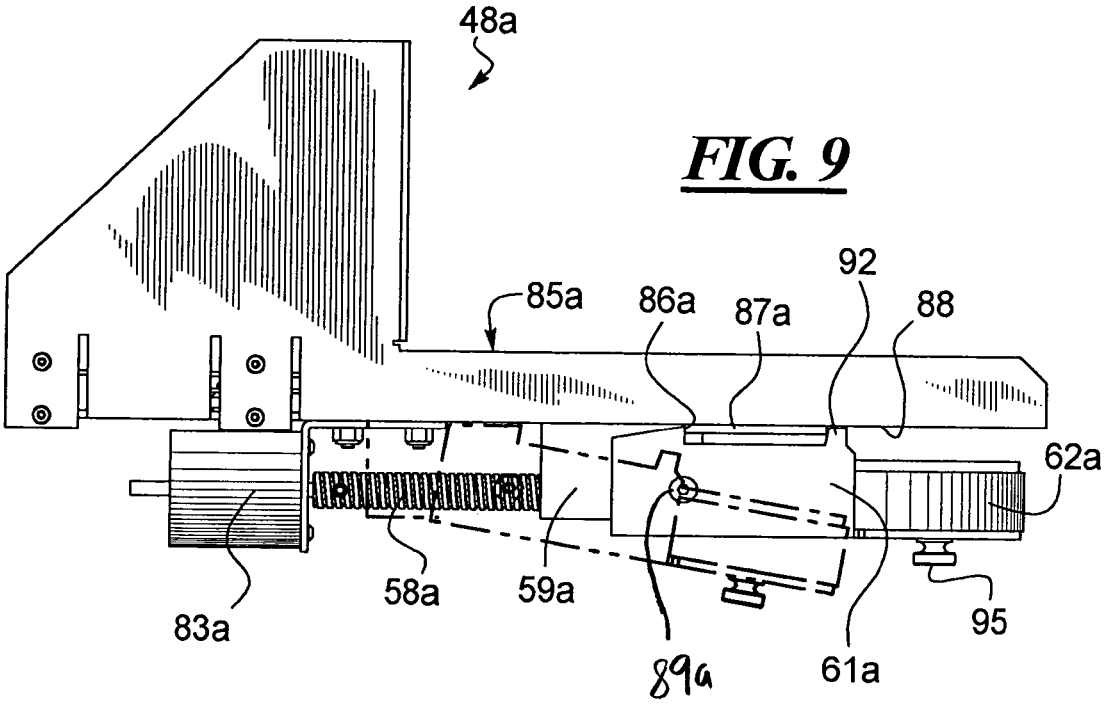
FIG. 9 is a side plan view of the closure mechanism for the manifold illustrated in part in FIGS. 1-3.
Figure 13:
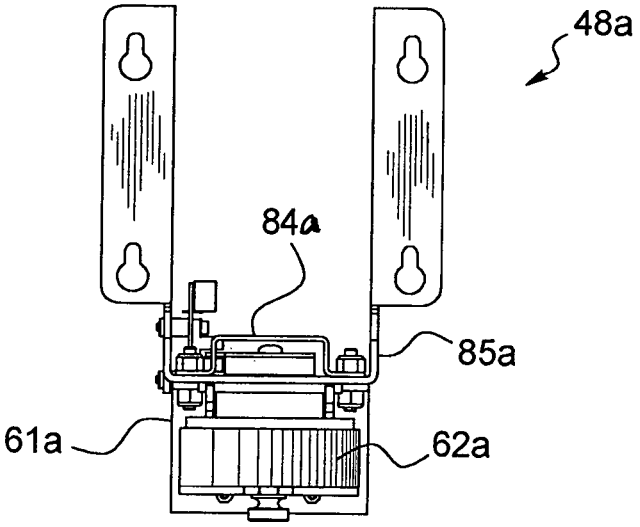
FIG. 13 is a front plan view of the closure mechanism shown in FIGS. 9-12.

Turning to FIGS. 9-13, the manifold closure mechanism 48*a* is shown and described. The closure mechanism 48*a* includes a motor 83*a* which rotates the drive shaft 58*a*. The drive shaft 58*a*, in turn, is threadably coupled to the slide block 59*a*. The slide block 59*a* is slidably supported within a track 84*a* formed in the supporting frame 85*a*. Rotation of the drive shaft 58*a* by the motor 83*a* results in movement of the slide block 59*a* along the track 84*a*. The slide block 59*a* is pivotally connected to the bracket 61*a* which, in turn, is connected to and supports the drip catcher 62*a*. Referring to FIG. 9, when the catch 86*a* of the bracket 61*a* engages the abutment 87*a* disposed on the underside 88 of the supporting bracket 85*a* as shown in FIG. 9, the bracket 61*a* and drip catcher 62*a* are pivoted upward to the position in shown in solid lines in FIG. 9. When the slide block 59*a*, bracket 61*a* and drip catcher 62*s* are retracted to the left in FIG. 9, the drip catcher 62*a* and bracket 61*a* pivot downward and to the left as shown in phantom lines in FIG. 9 due to the pivotal connection between the bracket 61*a* and the slide block 59*a* at the pin 89*a* and the force of gravity. Thus, in the position shown in solid lines in FIG. 9 and in FIGS. 10 and 11, the motor 83*a* has rotated the drive shaft 58*a* so that the slide block 59*a* has traversed to the right along the track as shown in FIG. 9 so that the catch 86*a* of the bracket 61*a* has engaged the abutment 87*a* thereby pivoting the bracket 61*a* and drip catcher 62*a* upward to the position shown in solid lines in FIG. 9 as well as in FIGS. 10 and 11. The tab 92 of the bracket 61*a* serves as a stop for limiting the upward pivotal movement of the bracket 61*a* and drip catcher 62*a* as the tab 92 engages the underside 88 of the supporting bracket 85*a*.

As shown in FIG. 12, the bracket 85*a* includes an opening 93*a* for accommodating the manifold block 64*a* discussed below in connection with FIGS. 17-19. The drip catcher 62*a* is also threadably connected to the underside 94 of the bracket 59*a* by way of the threaded fastener 95 which enables the drip catcher 62*a* to be easily removed and cleaned. Further, the drip catcher 62*a* includes a resilient ring 96 for sealingly engaging the manifold block 64*a* (see FIG. 3) and FIGS. 17-19.

Figure 14:
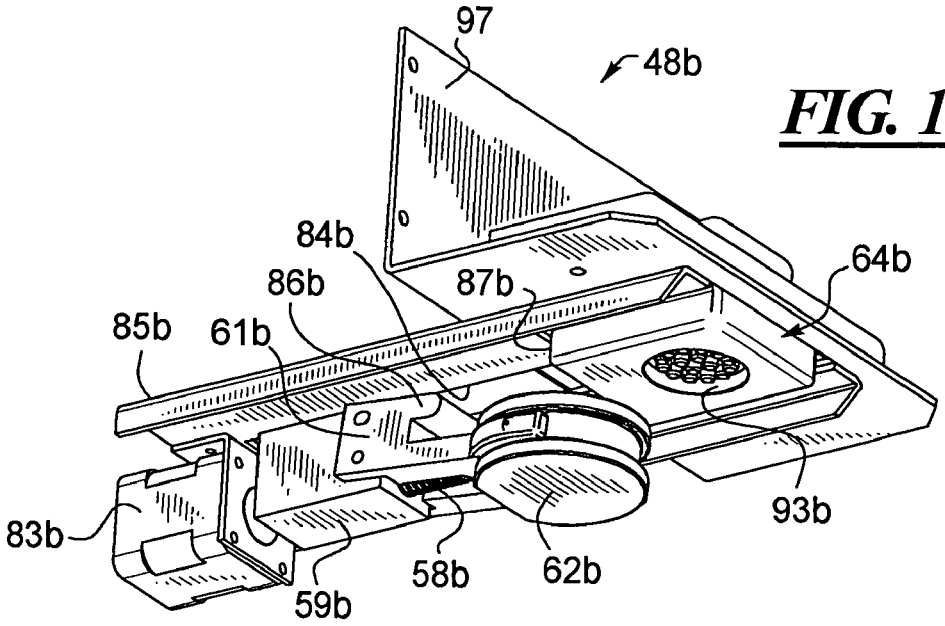
FIG. 14 is a perspective view of an alternative embodiment of a closure mechanism.
Figure 15:
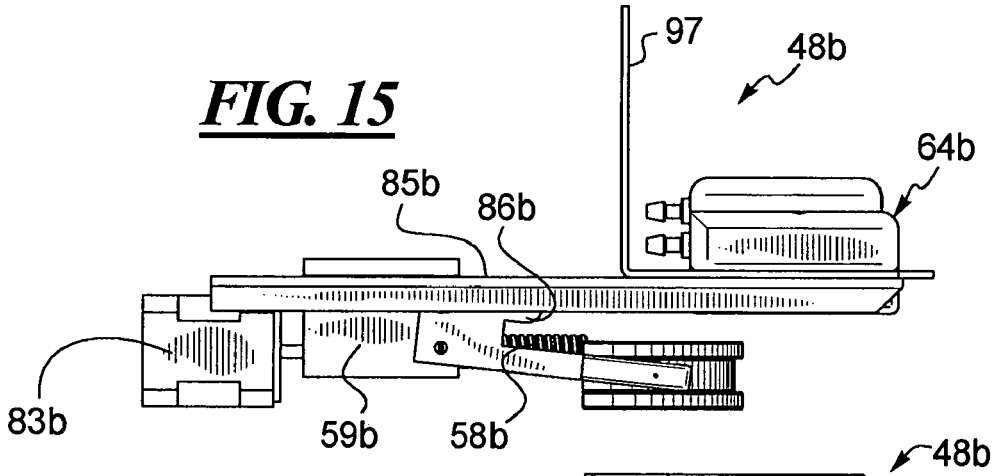
FIG. 15 is a side plan view of the closure mechanism shown in FIG. 14.
Figure 16:
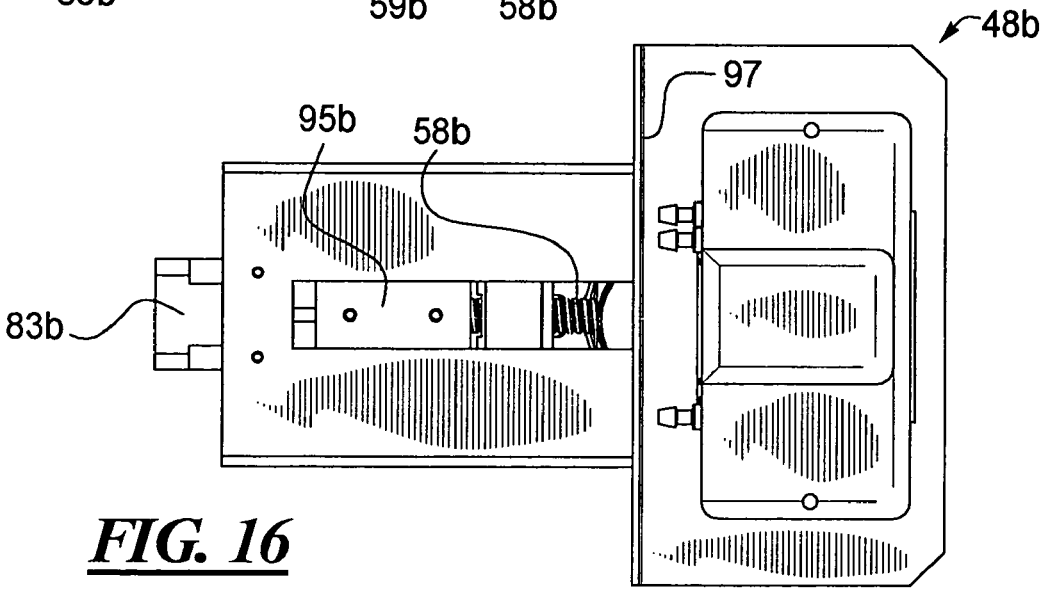
FIG. 16 is a top plan view of the closure mechanism shown in FIGS. 14 and 15.

An alternative manifold closure mechanism 48*b* is illustrated in FIGS. 14-16. The mechanism 48*b* includes a bracket 97 for mounting to the manifold module 46. An alternative embodiment of a manifold block is shown at 64*b*. A motor 83*b* rotates a drive shaft 58*b* which, in turn, moves a slide block 59*b* towards the manifold 64*b*. The slide block 59*b* is pivotally connected to the drip catcher 62*b* by way of the bracket 61*b*. The bracket 61*b* includes a rounded catch 86*b* that engages the rear wall 87*b* of the manifold 64*b* and pivots the drip catcher 62*b* upward in a manner similar to that of the closure mechanism 48*a* illustrated in FIGS. 9-13 above.

Still another manifold closure mechanism or module 48*c* is illustrated in FIGS. 31-37 and described below.

Figure 17:
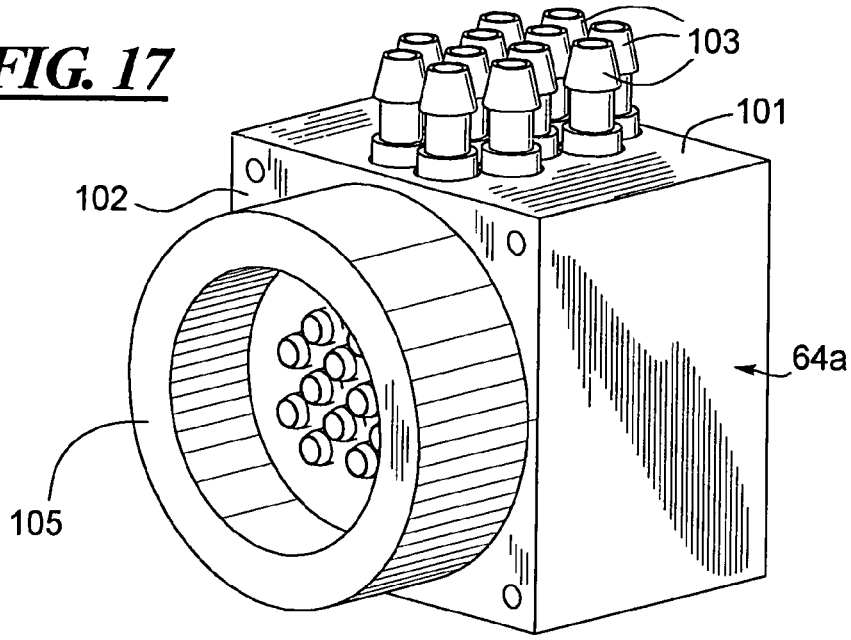
FIG. 17 is a perspective view of a manifold for use in the disclosed fluid dispenser.
Figure 18:
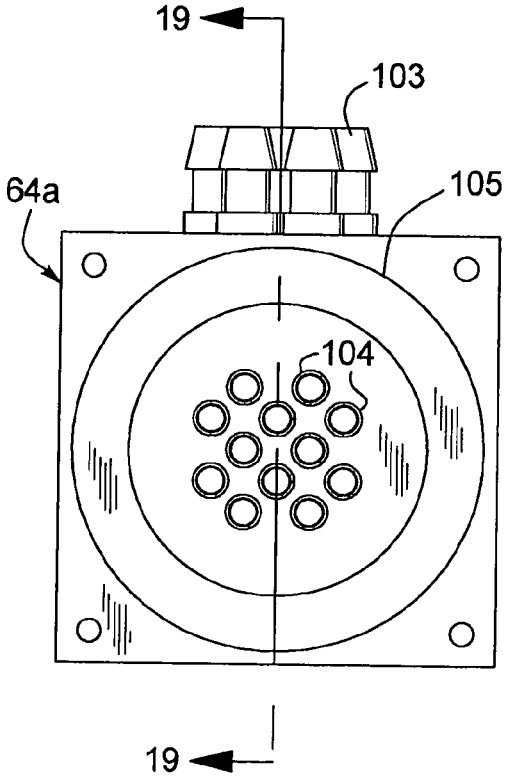
FIG. 18 is a bottom plan view of the manifold shown in FIG. 17.
Figure 19:
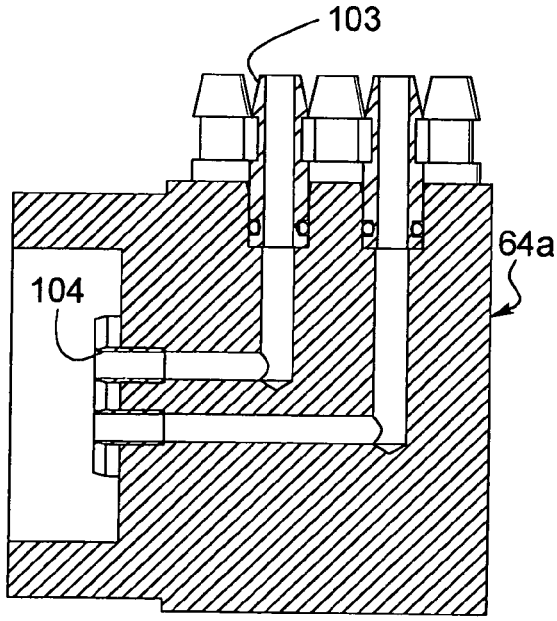
FIG. 19 is a sectional view taken substantially along the line 19-19 of FIG. 18.
Figure 20:
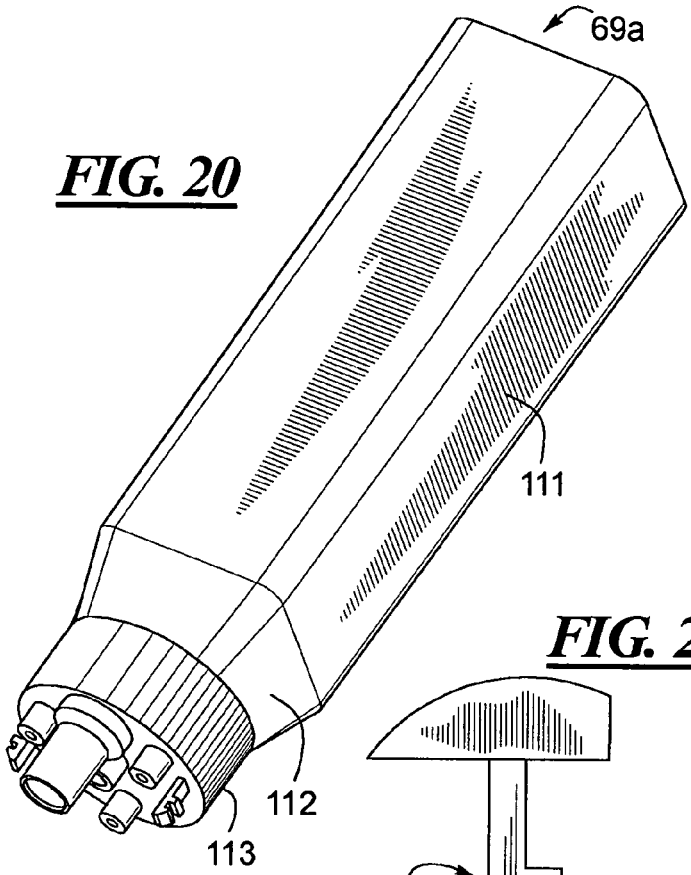
FIG. 20 is a perspective view of a vertical canister shown above in connection with FIGS. 4-6.
Figure 22:
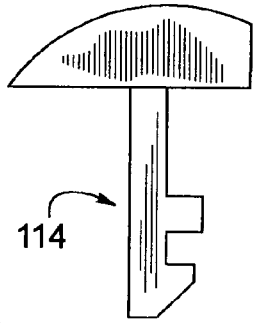
FIG. 22 is an enlarged partial view of the mounting tab for connecting the canister shown in FIGS. 20 and 21 to the module frame illustrated in FIGS. 5 and 6.
Figure 21:
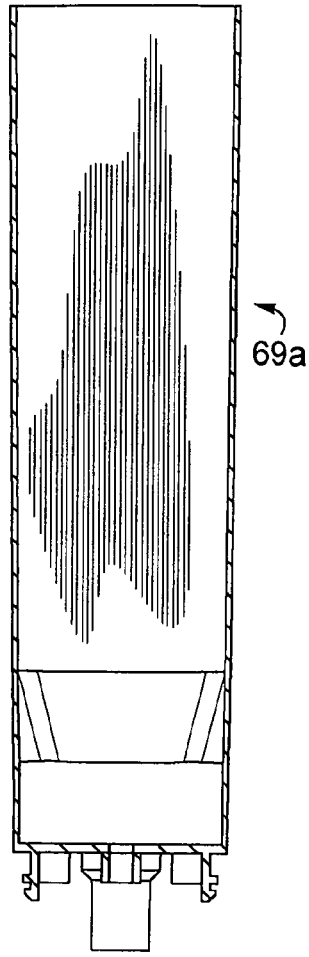
FIG. 21 is a sectional view of the canister shown in FIG. 20.
Figure 30:
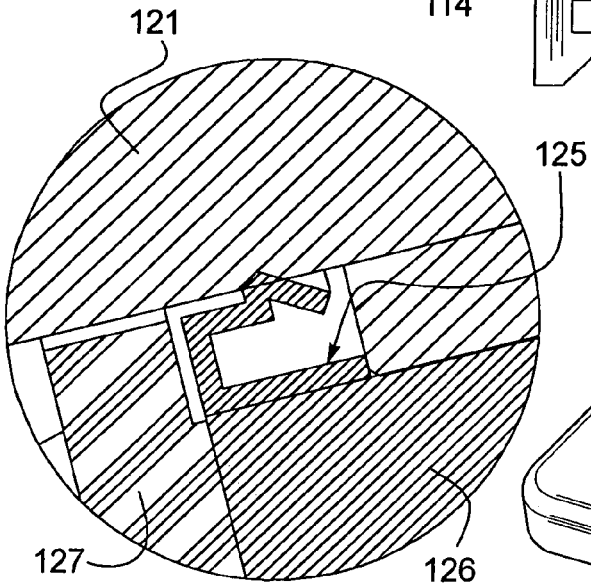
FIG. 30 is an enlarged partial view of the pump as shown in FIG. 29, particularly illustrating the drive shaft seal.
Figure 23:
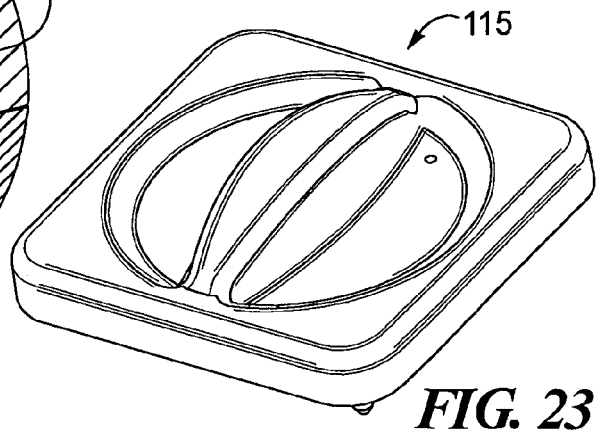
FIG. 23 is a perspective view of a top lid for the canister shown in FIGS. 20 and 21.

Turning to FIGS. 17-19, the manifold block 64*a* is described in greater detail. The block 64*a* includes an input end 101 and an output end 102 at a right angle thereto. The input end 101 includes a plurality of nozzles 103 that are connected to one of the pumps 74*a* or 74*b* (FIGS. 5-8). Each inlet nozzle 103 is in communication with an outlet nozzle 104 as shown in FIG. 19. Further, the outlet nozzles 104 are protected by a ring 105. The ring 105 is preferably sealingly engaged by a complementary sealing ring 96 of the closure mechanism 48*a*. Communication between the inlet nozzles 103 and outlet nozzles 104 are easily obtained by drilling two passages which are joined at a right angle as shown in FIG. 19.

Turning to FIGS. 20-23, the vertical canisters 69*a* are shown and described. The canisters 69 include an upper section 111 with a square or rectangular cross-section, a transition section 112 and a lower section 113 with a round cross-section. The upper portion 111 holds a greater amount of fluid as it can be stacked more closely to an adjacent canister as shown in FIG. 5 and therefore the upper sections with a rectangular or square cross-section provide a more efficient use of space. The lower section 113 with a round cross-section is required to more completely dispense all fluid contained within the canister 69*a* and therefore provides a more efficient use of the fluid provided in the canister 69*a*. The tab shown at 114 is used to secure the canister 69*a* to the upper portion 73*a* of the bracket 71*a* as shown in FIGS. 5 and 6. The lid 115 shown in FIG. 23 prevents the contents of the canister 69*a* from drying out.

Figure 24:
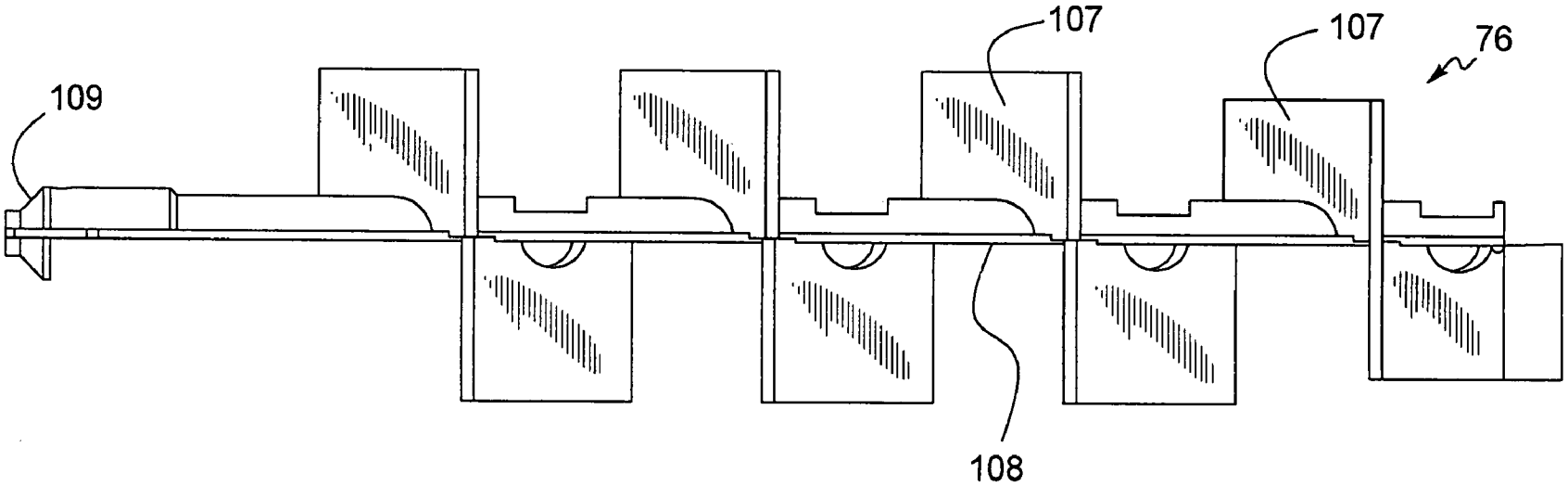
FIG. 24 is a plan view of an agitator paddle used in the vertical canister disclosed in FIGS. 20-23.
Figure 25:
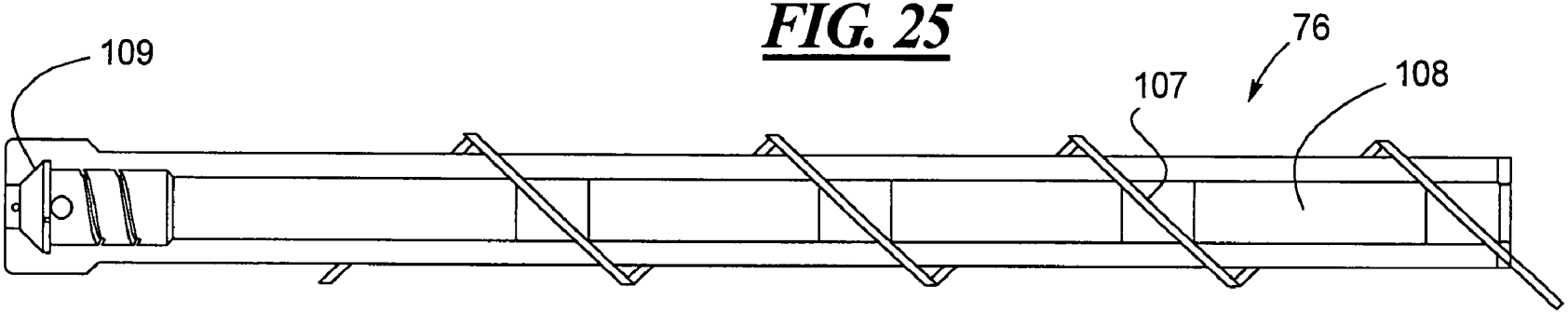
FIG. 25 is another side plan view of the agitator paddle shown in FIG. 24.

Turning to FIGS. 24 and 25, the agitator paddles 76 are shown in greater detail. Suitably placed fins 107 are mounted to a central shaft portion 108 and a lower fitting 109 secures the agitator paddle 76 to its respective drive shaft 77 as shown in FIGS. 5 and 6.

Figure 26:
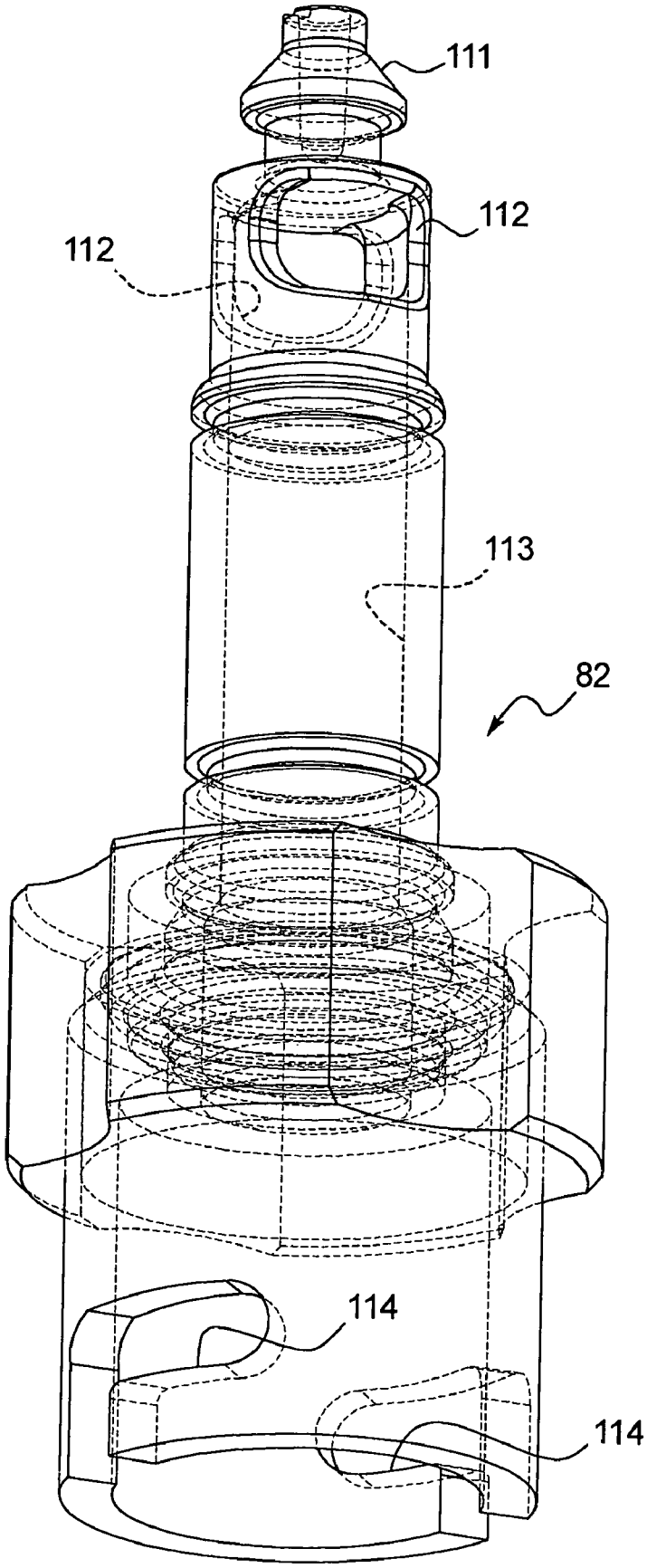
FIG. 26 is an elevation view of a nozzle used to connect a flexible bag to a pump as illustrated in FIGS. 7 and 8 above.

Turning to FIG. 26, the nozzle 82 for connecting a pump 74*b* to a flexible bag 69*b* as illustrated in FIG. 7 is shown and described. The nozzle 82 includes an upper plunger 111 that penetrates a seal on a lower portion of the bag. Diametrically opposed inlet ports are shown at 112 which enables fluid to be drawn down through the passageway shown at 113. The passageway 113 includes a ball (not shown) and also serves as a check valve to prevent fluid from being pumped upward into the bag thereby providing one-way flow to the pump 73*b*. Lock-fitting slots are shown at 114 to connect the nozzle 82 to the pump 74*b*.

Turning to FIGS. 27-30, the pumps 74*a* are illustrated in greater detail. The pump 74*a* includes a motor 117 which rotates a drive shaft 118. The drive shaft 118 (see FIG. 29) is connected to a coupling 119 which, in turn, is connected to a piston 121. The piston 121 includes a recess 122 and its rotation causes fluid to be drawn through the inlet 123 and out the outlet 78. One novel feature of the pump 74*a* shown in FIGS. 27-29 is the seal shown at 125 and illustrated in greater detail in FIG. 30. Specifically, the seal 125 provides a unique seal between the piston 121, casing 126 and the housing 127.

Figures 31, 32, 33:
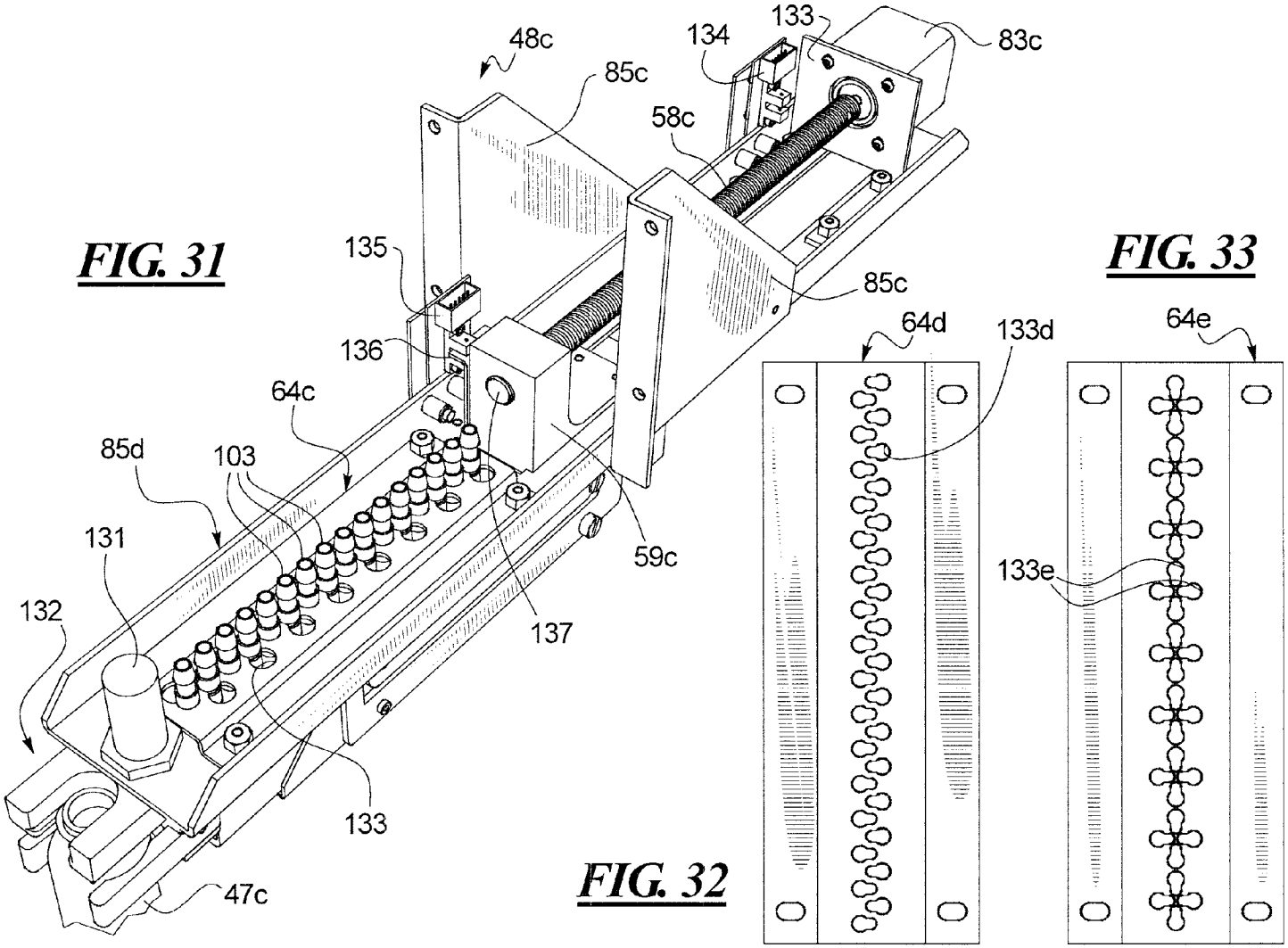
FIG. 31 is a perspective view of yet another alternative closure mechanism module.
FIGS. 32 and 33 are top plane views of alternative embodiments for the nozzle plate shown in FIG. 31 enabling more dense arrangements of the nozzles, although still in somewhat linear arrangements.

Turning to FIG. 31, the closure mechanism 48*c* includes a pair of supporting bracket 85*c* connected to a supporting frame 85*d*. The supporting frame 85*d* supports or is connected to a sensor 131 that detects and verifies when the container holder 132 and container 47*c* are in the initial closed position shown in FIG. 31 and which will be explained in greater detail below. The bracket or supporting frame 85 also is connected to a manifold in the form of an elongated nozzle plate 64*c*. It will be noted that the nozzles 103 are disposed in a substantially linear orientation in FIG. 3.

In the alternative embodiments shown at 64*d* and 64*e* in FIGS. 32 and 33, the nozzle openings 133*d*, 133*e* are more closely spaced than the nozzles openings 133 shown in FIG.

31. While the manifold enclosure system 48*c* is primarily a linear system with a linear arrangement of nozzles 103, the nozzles 103 can also be arranged in a staggered linear relationship as shown in FIG. 32 or in a linear arrangement of groupings of nozzles as shown in FIG. 33. Another alternative would be to have a linear arrangement of groupings of 3 (not shown).

A motor 83*c* and drive shaft 58*c* are shown in FIG. 31 as connected to a slide block 59*c*. FIG. 34 is a an exploded view illustrating the relationship between the nozzles 103, the manifold or nozzle plate 64*c* and the support frame or bracket 85*d*. The support frame 85*d* includes a track 84*c* for accommodate the slide block 59*c* which moves forward and rearward along the track 84*c* in accordance with the rotation of the drive shaft 58*c*. The motor 83*c* is connected to the support frame 85*d* by the bracket 133. Two sensors are shown at 134, 135. A sensing tab 136 is mounted to one side of the slide block 59*c* as shown in FIG. 31, the sensor 135 senses the arrival of the slide block 59*c* and tab 136 at the distal end 137 of the drive shaft 58*c* (FIG. 31) or the distal end 138 of the track 84*c* (FIG. 34). In contrast, the sensor 134 senses the arrival of the slide block 59*c* and tab 136 at the proximal end 139 of the track 84*c* as shown in FIG. 34.

Still referring to FIG. 34, an abutment plate 87*c* is mounted to the underside of the support frame 85*d*. This abutment plate 87*c* is engaged by the catches 86*c* of the u-shaped brackets 141 that, along with the straight brackets 142 and drip catcher bracket 143, form a bracket assembly that connects the drip catcher 62*c* to the slide block 59*c* by way of the connecting block 144. The container holder 132 is detachably connected to the front end 145 of the drip catcher 62*c* so that it can be easily changed or modified to accommodate a container 47*c* of a different configuration. Specifically, the main frame 146 can be changed to accommodate a smaller or a larger container or the opposing gripping legs 147 may be changed, or both. The drip catcher 62*c* is slidably but firmly connected to the bracket 143 by the blocks shown at 148. The blocks 148 are received in the tracks 149 disposed on opposing sides of the drip catcher 62*c*. A ramped track 155 is disposed on the bottom of the drip catcher 62*c* (not shown) which snaps into place over the spring-biased detent or button 156 disposed in the bottom of the bracket 143 to secure the drip catcher 62*c* in place.

Turning to FIGS. 35 and 36, the initial closed or ready position is shown in FIG. 35. A motor 83*c* has received a signal from the manifold board 68 (FIG. 4) to move the container to the load/unload position or the closed position shown in FIG. 35. The motor 83*c* has rotated the drive shaft 58*c* so that the slide block 59*c* has been moved axially forward to the position shown in FIG. 35 where the tab 136 (FIGS. 31 and 34) has been received in the sensor 135. In this position, the presence of the container holder 132 is sensed by the sensor 131. The catcher 86*c* of the u-shaped brackets 141 have engaged the abutment plate 87*c*. As a result, the brackets 141, with assistance from the brackets 142 have been pivoted upward so that they carry the drip catcher 62*c* to the upward and forward position shown in FIG. 35 where the container 47*c* and container holder 132 are disposed in front of the nozzle plate 64*c* and whereby the upper rim 96*d* of the drip catcher 62*d* has engaged the underside of the support plate 85*d* thereby covering the bottom ends of the nozzles 103.

To move to the position shown in 36 whereby the upper rim 96*d* of the drip catcher 62*c* has been released from the bottom of the support plate 85*d*, the motor 83*c* has rotated the shaft 58*c* so that the catches 86*c* of the u-shaped brackets 141 have been released from the abutment plate 87*c* thereby allowing the force of gravity to pivot the container holder 132, container 47*c* and drip catcher 62*c* downward to the position shown in solid lines in FIG. 36. As the motor 83*c* continues to rotate the shaft 58*c*, the moving components including the slide block 59*c*, connecting block 144, drip catcher 62*c*, brackets 141 and 142 move rearwardly towards the position shown in phantom lines in FIG. 36. When the apparatus 48*c* has been moved to the fully rearward position (left of the position shown in phantom in FIG. 36), the tab 136 is received in the sensor 134 and a signal is generated and relayed to the manifold board 68 (FIG. 4). Of course, numerous stops at various nozzles 103 are made along the way as various ingredients of a recipe are sequentially dispensed into the container 47*c*.

The sequence of a dispensing operation is explained the flow diagram of FIG. 37. At 200, a recipe has been selected and at 201 a container or bottle 47*c* has been loaded into the container holder 132. If not already in the closed position shown in FIG. 35, the indexer 48*c* is moved to the closed position shown in FIG. 35 at step 202. Confirmation of a successful move is made at step 203 and the presence of the container holder 132 (or container 47*c*) by the sensor 131 is made at step 204. Confirmation that the container 47*c* is present is made at step 205. With the recipe already selected, the indexer 48*c* is moved from the position shown in 35 to an open position between the position shown in solid line in FIG. 36 and the position shown in phantom line in FIG. 36. The first position arrived at step 206 is the first ingredient to be dispensed in accordance with the recipe. Confirmation that the move was successful is made at step 207 and, after a delay at step 208, a command is sent to the appropriate pump to dispense material through its individual nozzle 103 and into the container 47*c*. Confirmation that the dispense of the first ingredient was successful is made at step 210 and another delay is carried out to wait for a possible drip at step 211. If more materials are to be dispensed at 212, the system loops back to step 206 where the indexer 48*c* is moved to the appropriate position for the next ingredient. If any problems arise at steps 205, 207 or 210, the indexer moves back to the initial load/unload position shown in FIG. 35 at step 213.

The flow chart shown in FIG. 37 is appropriate for sequential dispensing in general and is not limited to the linear manifolds or nozzles plates 85*d*, 85*e* or 85*f* shown in FIGS. 31-33. Other variations will be apparent to those skilled in the art.

While only certain embodiments have been set forth, alternative embodiments and various modifications will be apparent from the above description to those skilled in the art. These and other alternatives are considered equivalents and within the spirit and scope of this disclosure.

What is claimed is:

1. A manifold and nozzle closure system for a fluid dispenser, the manifold and closure system comprising:

a manifold for supporting a plurality of downwardly directed nozzles, a motor connected to an actuator, the actuator being threaded drive shaft that is threadably coupled to a slide block, the slide block being pivotally coupled to the drip catcher, the motor being disposed rearwardly from the manifold, the actuator being directed towards the manifold, the actuator being pivotally coupled to the drip catcher, the drip catcher comprising a front end that is connected to a container holder, the actuator, drip catcher and container holder being movable by the motor between a closed position where the drip catcher is disposed beneath the manifold and nozzles and serving as a bottom cover for the nozzles and where the container holder is disposed in front of the manifold, and one or more open positions where the container holder is disposed beneath one or more of the nozzles and where the drip catcher has been moved pivotally downward and rearward relative to the closed position.

2. The manifold and closure system of claim 1 further comprising a catch and an abutment, the drip catcher and container holder pivoting upward to the closed position when catch engages the abutment as the drive shaft is rotated to move the slide block, drip catcher and container holder forward to the closed position.

3. The manifold and closure system of claim 1 wherein the manifold comprises an elongated plate and the nozzles are accommodated in the plate and aligned in a single row, a single staggered row or a single row of nozzles arranged in clusters.

4. The manifold and closure system of claim 1 wherein the drip catcher comprises an upwardly facing rim that can sealingly engage an underside of the manifold.

5. The manifold and closure system of claim 1 further comprising a proximity sensor disposed in front of the manifold to detect the presence of a container accommodated in the container holder when the drip catcher is in the closed position.

6. The manifold and closure system of claim 1 wherein the container holder is detachably connected to the front end of the drip catcher so the container holder can be exchanged or modified to accommodate containers of varying sizes.

7. The manifold and closure system of claim 1 further comprising a connecting block disposed beneath and connected to the slide block, the connecting block connecting the slide block to a bracket assembly, the connecting block being pivotally connected to the drip catcher by the bracket assembly.

8. The manifold and closure system of claim 2 wherein the abutment is disposed on an underside of the supporting frame.

9. The manifold and closure system of claim 1 wherein the catch is disposed on the bracket assembly.

10. The manifold and closure system of claim 1 wherein rotation of the drive shaft in an opposite direction results in rearward movement of the slide block, bracket assembly and drip catcher away from the front end of manifold.

11. The manifold and closure system of claim 1 wherein the manifold is connected to a supporting frame and the slide block is slidably supported by the supporting frame.

12. The manifold and closure system of claim 1 further comprising a connecting block disposed beneath the slide block and connecting the slide block to the bracket assembly, the connecting block being pivotally connected to the drip catcher by the bracket assembly.

13. The manifold and closure system of claim 1 wherein the manifold comprises an elongated nozzle plate aligned with the drive shaft, and wherein the nozzles are connected to the nozzle plate in a single row, a single staggered row, or a single row of nozzle clusters extending between the front and rear ends of the nozzle plate.

14. A manifold and nozzle closure system for a fluid dispenser, the manifold and closure system comprising:

a manifold for supporting a plurality of downwardly directed nozzles, a motor connected to an actuator, the motor being disposed rearwardly from the manifold, the actuator being directed towards the manifold, the actuator being pivotally coupled to a drip catcher, the drip catcher comprising a front end that is connected to a container holder, the actuator, drip catcher and container holder being movable by the motor between a closed position where the drip catcher is disposed beneath the manifold and nozzles and serving as a bottom cover for the nozzles and where the container holder is disposed in front of the manifold, and one or more open positions where the container holder is disposed beneath one or more of the nozzles and where the drip catcher has been moved pivotally downward and rearward relative to the closed position, and a proximity sensor disposed in front of the manifold to detect the presence of a container accommodated in the container holder when the drip catcher is in the closed position.

15. The manifold and closure system of claim 14 wherein the actuator is a threaded drive shaft that is threadably coupled to a slide block, the slide block being pivotally coupled to the drip catcher.

16. The manifold and closure system of claim 15 further comprising a catch and an abutment, the drip catcher and container holder pivoting upward to the closed position when catch engages the abutment as the drive shaft is rotated to move the slide block, drip catcher and container holder forward to the closed position.

17. The manifold and closure system of claim 14 wherein the manifold comprises an elongated plate and the nozzles are accommodated in the plate and aligned in a single row, a single staggered row or a single row of nozzles arranged in clusters.

18. The manifold and closure system of claim 14 wherein the drip catcher comprises an upwardly facing rim that can sealingly engage an underside of the manifold.

19. The manifold and closure system of claim 14 wherein the container holder is detachably connected to the front end of the drip catcher so the container holder can be exchanged or modified to accommodate containers of varying sizes.

20. The manifold and closure system of claim 15 further comprising a connecting block disposed beneath and connected to the slide block, the connecting block connecting the slide block to a bracket assembly, the connecting block being pivotally connected to the drip catcher by the bracket assembly.

* * * * *